US009978295B1

(12) United States Patent
Denby et al.

(10) Patent No.: US 9,978,295 B1
(45) Date of Patent: May 22, 2018

(54) GATEWAY DISPLAY FIXTURE WITH TRANSOM DISPLAY UNIT

(71) Applicant: TARGET BRANDS, INC., Minneapolis, MN (US)

(72) Inventors: Scott E. Denby, Minneapolis, MN (US); Jeremy A. Clark, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 0 days. days.

(21) Appl. No.: 15/446,580

(22) Filed: Mar. 1, 2017

(51) Int. Cl.

| | |
|---|---|
| ***E06B 9/00*** | (2006.01) |
| ***G09F 15/00*** | (2006.01) |
| ***A47F 7/24*** | (2006.01) |
| ***A47F 5/10*** | (2006.01) |
| *A47F 5/00* | (2006.01) |

(52) U.S. Cl.
CPC ..... *G09F 15/0056* (2013.01); *A47F 5/105* (2013.01); *A47F 7/24* (2013.01); *G09F 15/005* (2013.01); *A47F 2005/0075* (2013.01)

(58) Field of Classification Search
CPC .... A47F 5/105; A47F 7/24; A47F 2005/0075; A47F 5/10; A47F 10/02; G09F 15/0056; G09F 15/005; G09F 15/0068; A47G 25/0664; A47B 47/00; A47B 45/00; A47B 47/02; A47B 47/021; A47B 47/045; A47B 47/0025; A47B 47/025; A47B 27/027; A47B 47/03; A47B 47/05
USPC ..... 160/36, 127
See application file for complete search history.

(56) References Cited

U.S. PATENT DOCUMENTS

| | | | | |
|---|---|---|---|---|
| 1,161,934 A * | 11/1915 | Gilmore | A47B 45/00 211/182 |
| 2,855,037 A | 10/1958 | Stiffel | |
| 4,326,637 A * | 4/1982 | James | A47F 7/24 211/175 |
| 4,428,136 A | 1/1984 | Franklin | |

(Continued)

OTHER PUBLICATIONS

"Unlimited® Folding Panel Display", printed from www.downingdisplays.com/portable-displays/folding-frames/unlimited/#pd_prgal-tab, publicly available at least as early as Sep. 17, 2012, per http://web.archive.org (2 pages).

(Continued)

*Primary Examiner* — Brian D Mattei
(74) *Attorney, Agent, or Firm* — JoAnn M. Seaton; Griffiths & Seaton PLLC

(57) ABSTRACT

A gateway display fixture includes first and second side display unit and a transom display unit. The first side display unit includes a first primary frame including two threaded cavities along a top surface thereof. The second side display unit is spaced from the first side display unit. The transom display is unit selectively coupled with and extends across each of the first display unit and the second side display unit to form a pathway under the transom display unit. The transom display unit includes a bottom segment having a first pair of coupling apertures near a first end of the bottom segment. The display fixture is adjustable between a first configuration, where the first side display unit extends substantially in line with the transom display unit, and in the second configuration, where the first side display unit is rotated out of line with the transom display unit.

20 Claims, 22 Drawing Sheets

(56) References Cited

U.S. PATENT DOCUMENTS

| | | | | |
|---|---|---|---|---|
| 4,488,652 | A * | 12/1984 | Hinton | A47F 5/116 211/149 |
| 4,561,550 | A | 12/1985 | Franklin | |
| 4,655,352 | A * | 4/1987 | Noyes | A47F 5/0018 108/106 |
| 4,723,819 | A | 2/1988 | Ramberg | |
| 4,750,627 | A | 6/1988 | Myers | |
| D328,529 | S | 8/1992 | Lenarczyk | |
| D405,976 | S | 2/1999 | Beall | |
| 6,065,612 | A | 5/2000 | Rinderer | |
| 6,585,118 | B2 * | 7/2003 | Kellogg | A47F 3/001 211/13.1 |
| 6,951,291 | B2 * | 10/2005 | Kleanthis | G09F 15/00 211/163 |
| 8,469,208 | B2 | 6/2013 | O'Day et al. | |
| 9,217,273 | B2 | 12/2015 | Floersch et al. | |
| D777,460 | S | 1/2017 | Martell et al. | |
| 2002/0014466 | A1 | 2/2002 | Maier-Hunke | |
| 2007/0102384 | A1 | 5/2007 | Albenda | |
| 2009/0293391 | A1 | 12/2009 | Devore | |
| 2012/0031863 | A1 * | 2/2012 | Horn | A47B 47/0083 211/59.2 |
| 2013/0232836 | A1 * | 9/2013 | Holt | G09F 15/00 40/610 |
| 2014/0157637 | A1 * | 6/2014 | Logan | G09F 7/10 40/606.03 |
| 2014/0259831 | A1 * | 9/2014 | Denby | A47F 5/10 40/606.03 |
| 2015/0076312 | A1 * | 3/2015 | Angvall | A47F 5/0081 248/469 |
| 2015/0190001 | A1 * | 7/2015 | Floersch | E06B 5/006 160/36 |

OTHER PUBLICATIONS

"How to Make a Peg Board", printed from http://ourwicklessteam.blogspot.com/2009/04/how-to-make-peg-board.html, available on Apr. 8, 2009 (3 pages).

"Preston Floor Standing 3 Panel Room Divider", printed from www.wayfair.com/nexxt-Design-65-x-42-Preston-Floor-Standing-3-Panel-Room-Divider-PN18734-6-NEXX1082.html, publicly available at least as early as Jun. 9, 2015 (5 pages).

"Desktop Exhibition Stand—Folding Display Boards", printed from www.ebay.co.uk/itm/like/331625335796?clk_rvr_id=980233372294&item=331625335796&lgeo=1&vectorid=229508&rmvSB=true, publicly available at least as early as Feb. 10, 2016 (3 pages).

"Portable Display Panel and Dividers by Best-Rite", printed from www.wayfairsupply.com/Best-Rite%25C2%25AE-55-x-40-Portable-Display-Panels-and-Dividers-685D-XX-BS1083.html, publicly available at least as early as May 14, 2013, per http://web.archive.org (4 pages).

"3-Panel Rolling Aluminum Reinforced Lighted Slatwall Display", printed from www.warehouseofstuff.com/3_Panel_Rolling_Aluminum_Reinforced_Lighted_Slatwa_p/3259.htm, publicly available at least as early as Mar. 7, 2015 (2 pages).

* cited by examiner

GATEWAY DISPLAY FIXTURE WITH TRANSOM DISPLAY UNIT

BACKGROUND OF THE INVENTION

Retail stores often arrange for-sale merchandise by department and/or category. While some departments include substantially static aisle fixtures for supporting merchandise, other departments additionally and/or alternatively are outfitted with multiple movable fixtures arranged on a retail store footprint or pad assigned to the corresponding department. A single department included on the corresponding retail store footprint often supports merchandise of different categories therein, for example, of different brands, of different types, for different use, of different color, of different styles, etc.

SUMMARY

One embodiment of the invention relates to a gateway display fixture includes a first side display unit, a second side display unit, and a transom display unit. The first side display unit two threaded cavities along a top surface thereof, wherein the first side display unit extends substantially vertically away from a floor. The second side display unit extending substantially vertically away from a floor to a top surface thereof and being laterally spaced from the first side display unit. The transom display is unit selectively coupled with each of the first side display unit to form a walkable pathway under the transom display unit between the first side display unit and the second side display unit. The transom display unit includes a bottom segment having a first pair of coupling apertures near a first end of the bottom segment. The display fixture is adjustable between a first configuration and a second configuration. In the first configuration, the first side display unit extends substantially in line with the transom display unit and is coupled to the transom display unit via two fasteners each extending through a different one of the first pair of coupling apertures and a different one of the two threaded cavities. In the second configuration, the first side display unit is rotated out of line with the transom display unit and is coupled to the transom display unit via a single fastener extending through only one of the first pair of coupling apertures and only one of the two threaded cavities. Other display fixtures, display units, retail displays and methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the term "about" or "substantially" apply to all numeric values or descriptive terms, respectively, and generally indicate a range of numbers or characteristics that one of skill in the art would consider equivalent to the recited values or terms, that is, having the same function or results.

This innovation provides a gateway display fixture forming defined passage or entrance to different portions of a retail store helping to define such store portions and/or the merchandise offered for sale therein. The gateway display fixture includes two side display units and a transom display unit extending between the side display units in a bridge-like manner, forming a passageway therebetween. The gateway display is reconfigurable between various configurations by altering the transom display unit coupling with each side display unit and/or adjusting the angle each side display unit extends from the transom display unit. In this manner, one or more gateway display fixtures can be used in various configurations to change to overall look of a department, category, or other portion of the retail store providing visually related, but likely differently configured gateway display fixtures to provide interest and differentiation to each such department, category, etc. In one embodiment, gateway display fixture is further configured to support graphic panels and/or merchandise to further facilitate product display.

Figure 1:
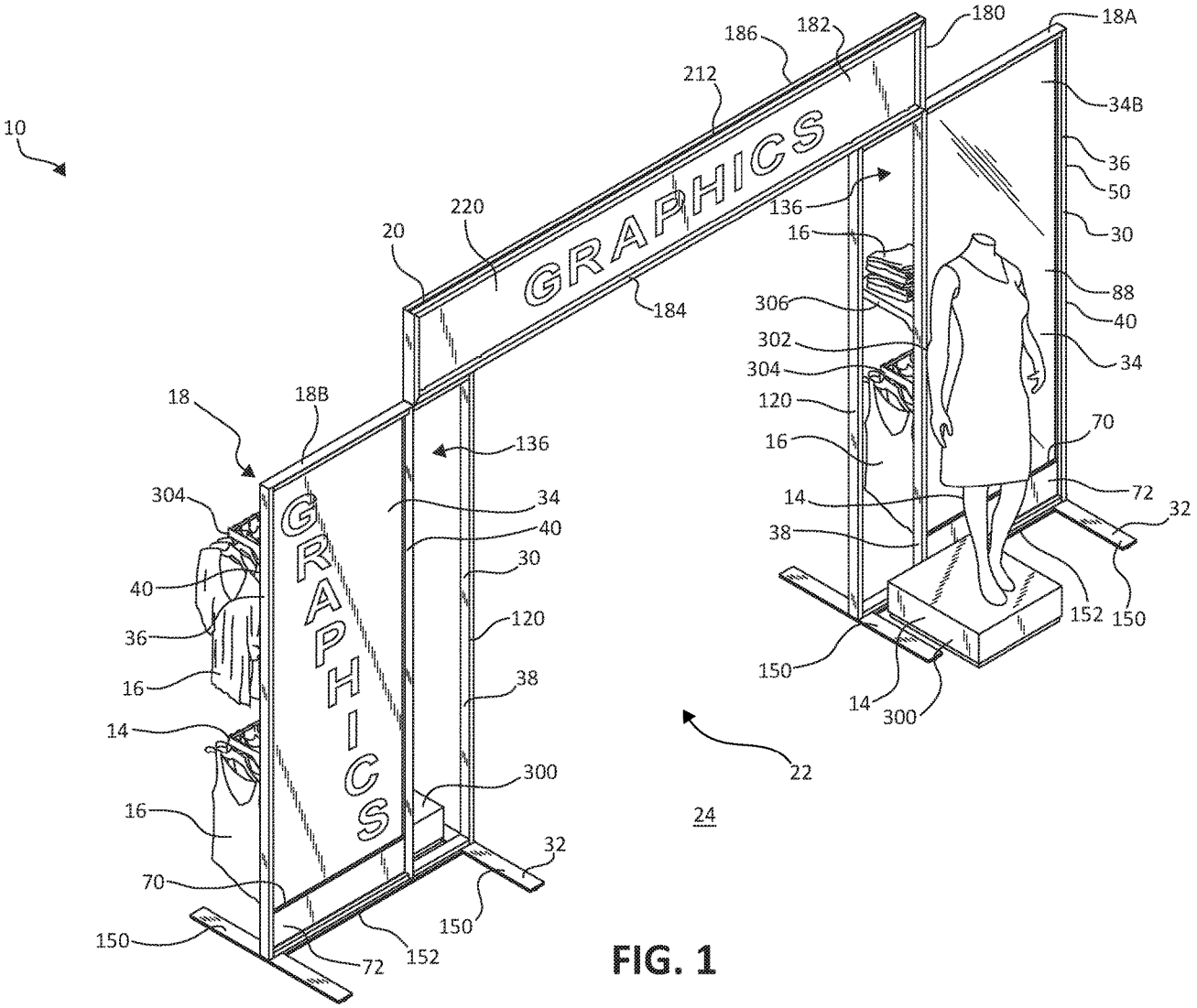
FIG. 1 is a front perspective view illustration of a retail display in a first configuration, according to one embodiment of the present invention.
Figure 2:
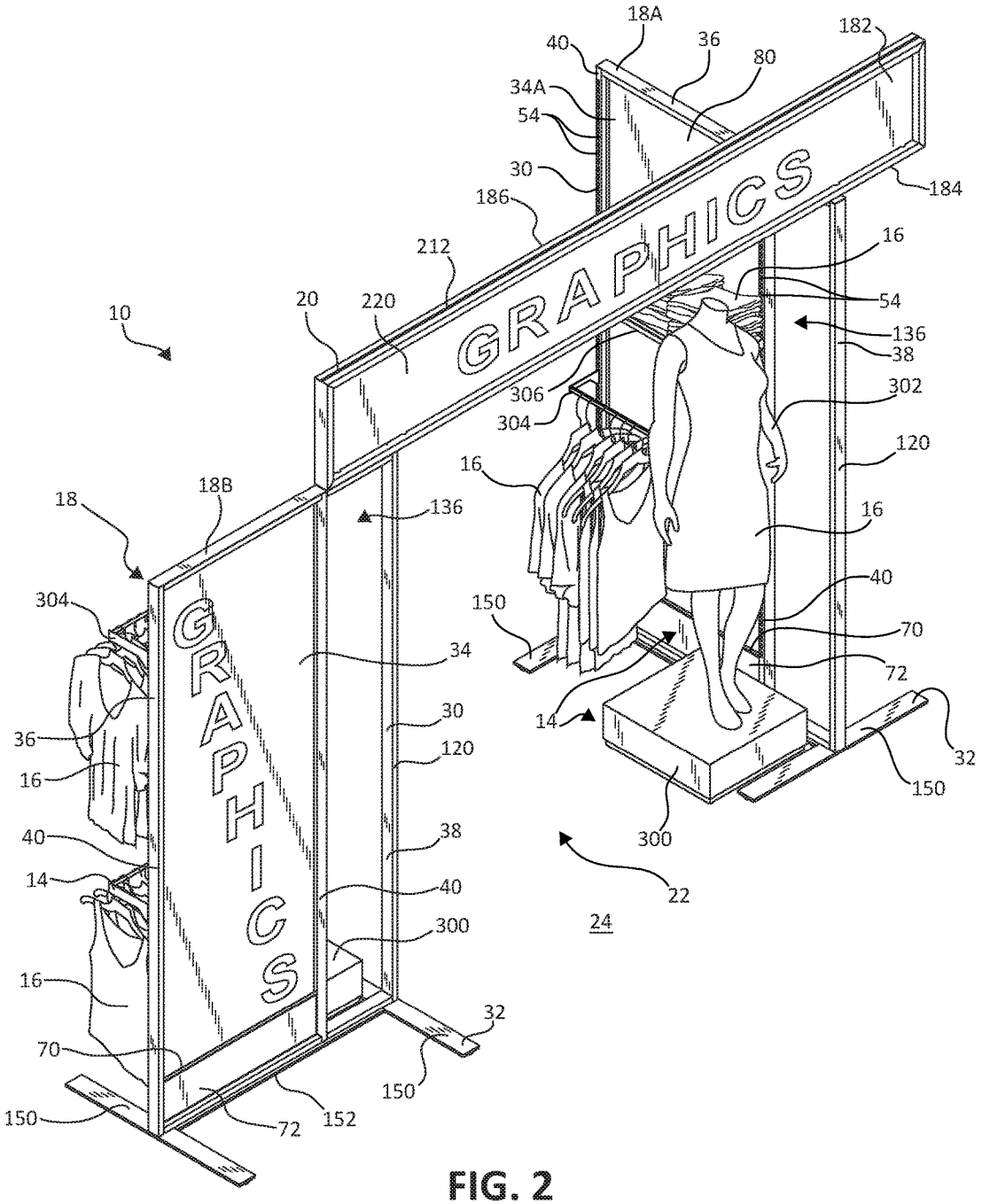
FIG. 2 is a front perspective view illustration of the retail display of FIG. 1 in a second configuration, according to one embodiment of the present invention.
Figure 3:
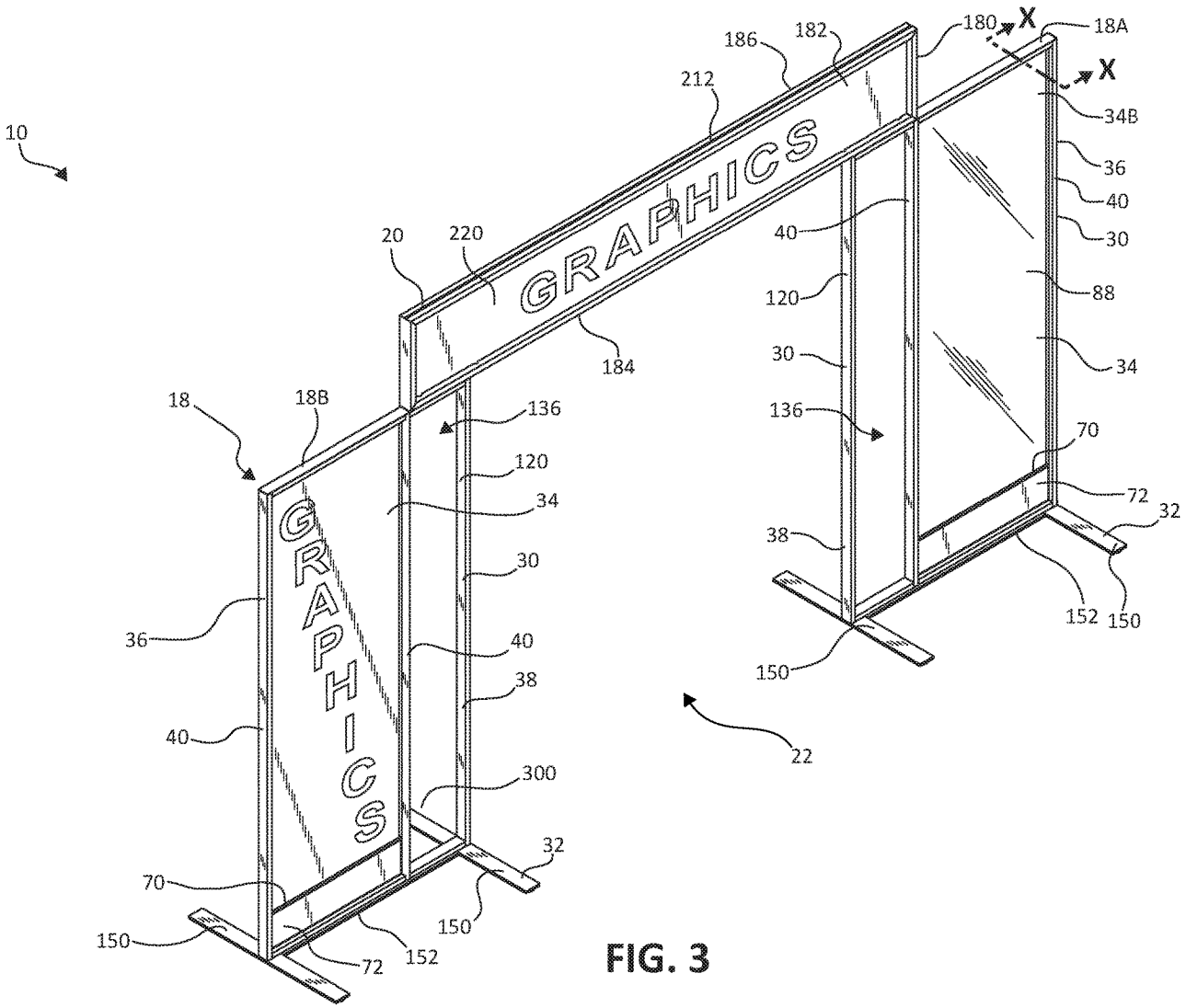
FIG. 3 is a front perspective view illustration of a display fixture of the retail display of FIG. 1 in a substantially linear configuration, according to one embodiment of the present invention.
Figure 4:
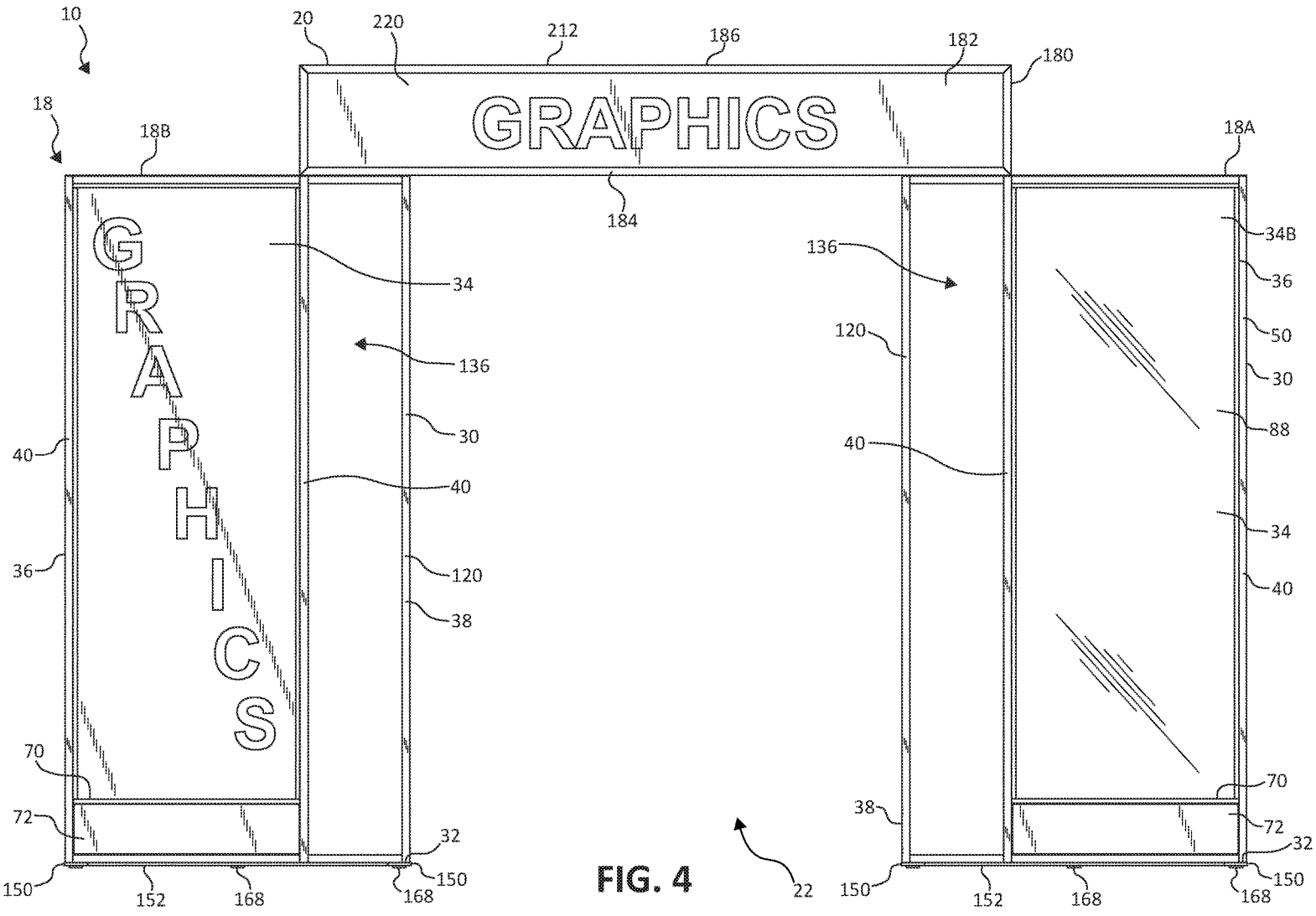
FIG. 4 is a front view illustration of the display fixture of FIG. 3, according to one embodiment of the present invention.
Figure 5:
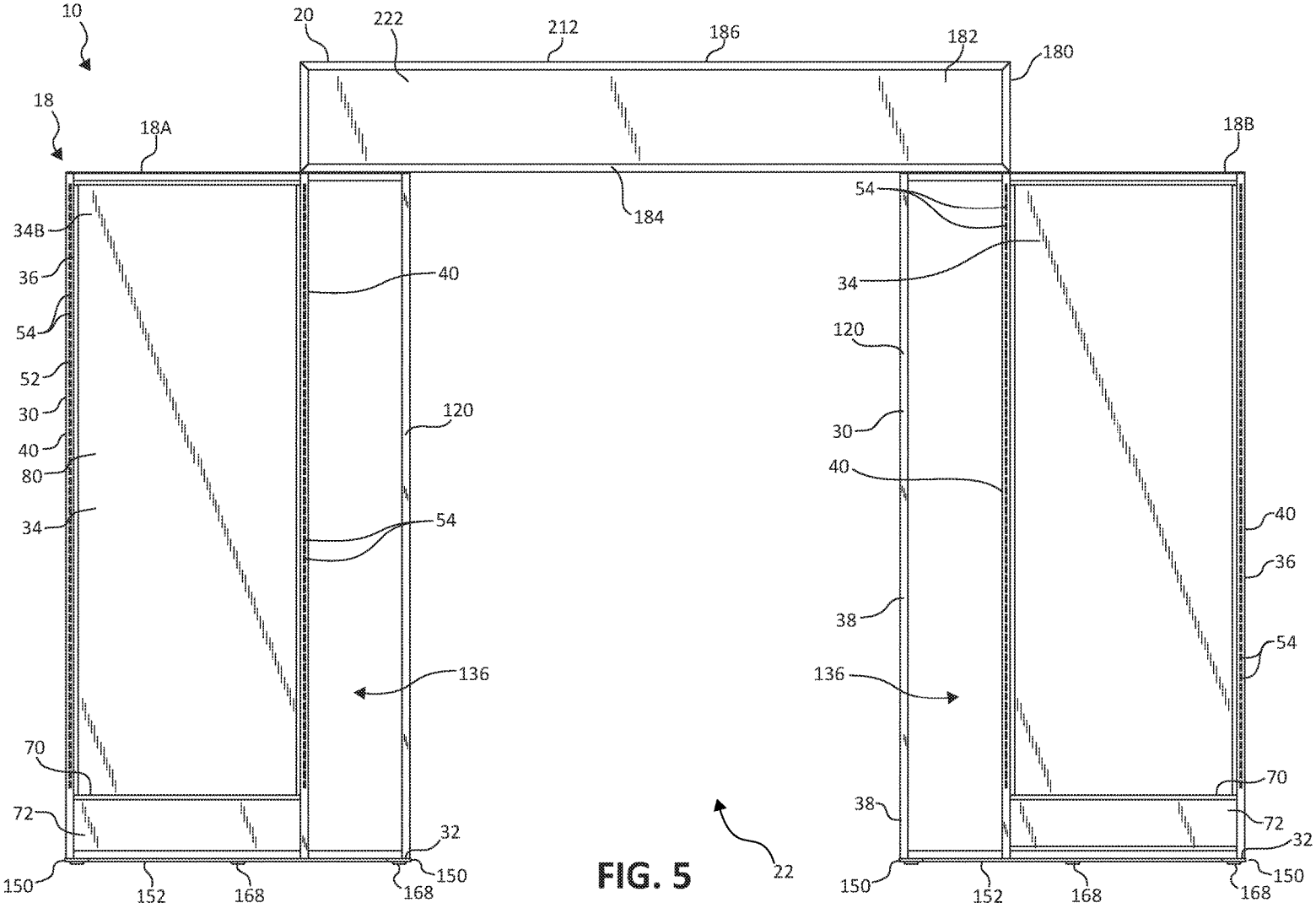
FIG. 5 is a rear view illustration of the display fixture of FIG. 3, according to one embodiment of the present invention.
Figure 6:
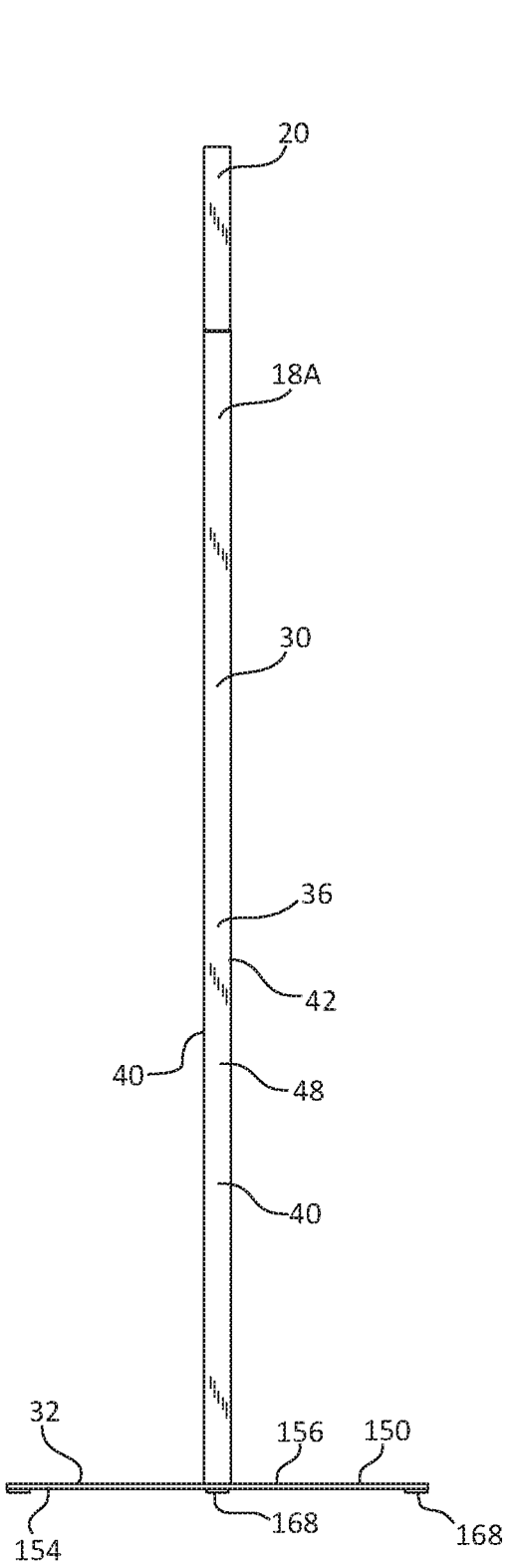
FIG. 6 is a right side view illustration of the display fixture of FIG. 3, according to one embodiment of the present invention.
Figure 7:
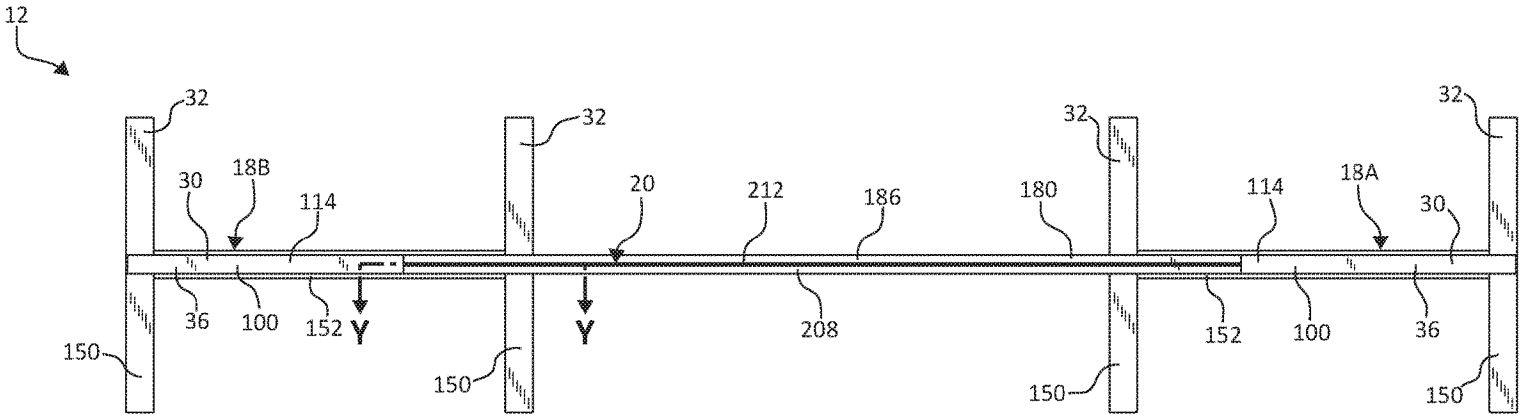
FIG. 7 is a top view illustration of the display fixture of FIG. 3, according to one embodiment of the present invention.
Figure 8:
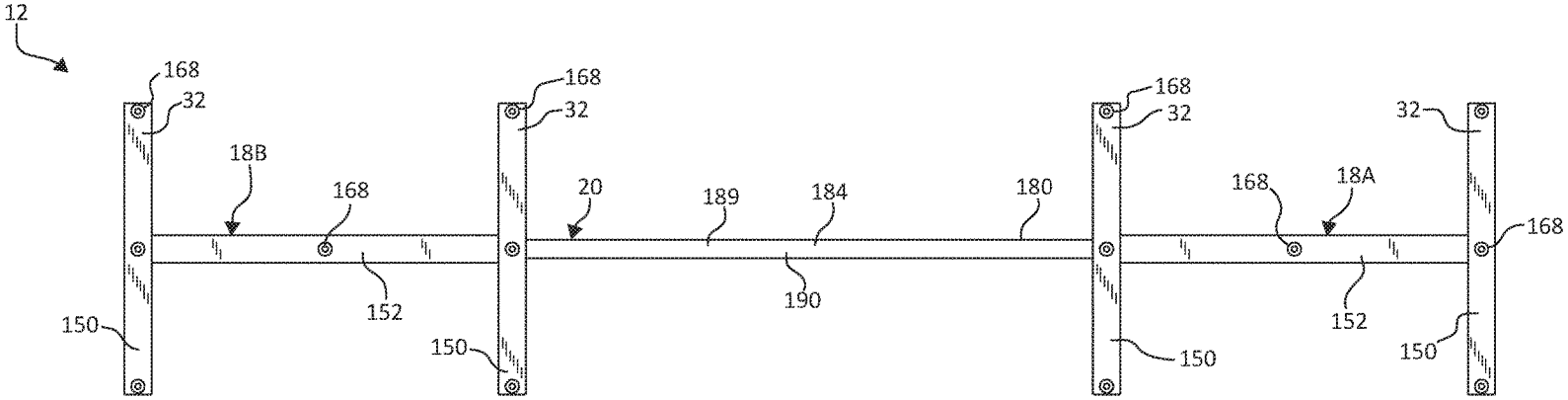
FIG. 8 is a bottom view illustration of the display fixture of FIG. 3, according to one embodiment of the present invention.

Turning to the Figures, FIGS. 1 and 2 illustrate a retail display 10, for example, in a retail store including a gateway display fixture 12, auxiliary display components 14, and for-sale merchandise 16. Gateway display fixture 12 is reconfigurable between a plurality of configurations, including a first, substantially linear configuration as shown in FIG. 1 and a second, substantially nonlinear configuration, for example, the L-shaped configuration shown in FIG. 2, among others. The multiple configurations of gateway display fixture 12 provide various presentations of a pass-through or use in different portions of a retail store pad corresponding with different categories of merchandise, different brands of merchandise, different styles of merchandise, different sizes of merchandise, or any other specific breakdown of merchandise categories. In addition, gateway display fixture 12 is readily reconfigurable to change the look of a display or to create a different display when a retail store set changes and/or the use of gateway display fixture 12 evolves. Gateway display fixture 12 is configured for use with various auxiliary display components 14 that may be used in concert with and/or supported by gateway display fixture 12 for collectively supporting merchandise, sample displays, etc. In addition, gateway display fixture 12 provides various opportunities for graphical marketing, etc. to identify, promote, defines, etc. the related merchandise displayed thereon and/or nearby.

Additionally referring to the various views illustrated in FIGS. 3-8, in one embodiment, gateway display fixture 12 is shown in a first, and this instance, a substantially linear, configuration and includes side display units 18 and a transom display unit 20. Side display units 18 include two side display units 18, such as a first side display unit 18A and a second side display unit 18B, in one embodiment. Each side display unit 18 is configured to freely stand without additional support extending upwardly from a retail store pad or floor 24 to support transom display unit 20, which extends between tops of each of first and second side display units 18A and 18B to collectively form a gateway display fixture 12 with a walkable pathway or walkway 22 therebetween. In one embodiment, the different configurations of gateway display fixture 12 are formed by varying the angle at which each side display unit 18 extends relative to transom display unit 20 and/or the position at which each side display unit 18 is coupled to transom display unit 20, as will be further described below.

Figure 9:
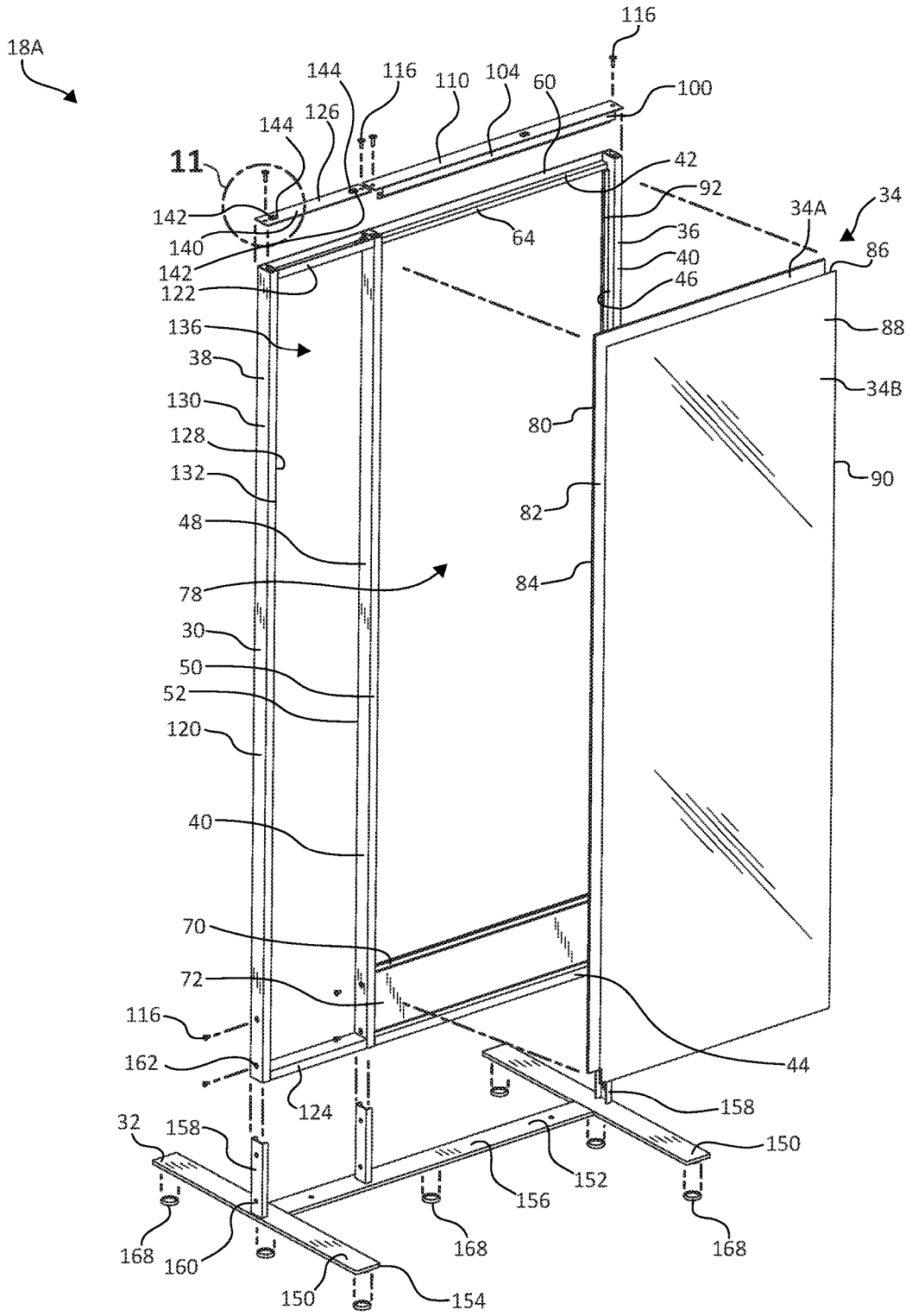
FIG. 9 is a partially exploded, front perspective view of a side display unit of the display fixture of FIG. 3, according to one embodiment of the present invention.

FIG. 9 is an exploded view of first side display unit 18A including a primary frame 30, a footed support 32, and panels 34. While first side display unit 18A is described in detail below, it should be understood that, in one embodiment, second side display unit 18B similarly includes a footed support 32, primary frame 30, and a panels 34 in a manner substantially identical to first side display unit 18A other than slight variations, for example, as described as optional features herein or that would otherwise be apparent to those of skill in the art upon reading this application. Primary frame 30 extends in a substantially vertical orientation with a primarily two-dimensional presentation other than a substantially minor depth of primary frame 30. In one embodiment, primary frame 30 is substantially rectangular, and in one example, includes two or more portions, such as a principle frame portion 36 and an auxiliary frame portion 38.

In one embodiment, primary fame 30 includes a principle frame portion 36 and an auxiliary frame portion 38 positioned side-by-side, for example, adjacent each other. In one example, principle frame portion 36 and auxiliary frame portion 38 are substantially identical in height to collectively form top and bottom surfaces of primary frame 30 as will be further described below.

Principle frame portion 36 is substantially rectangular and, in one embodiment, includes two upright members 40, a first top cross bar 42, and a bottom cross bar 44. In one embodiment, upright members 40, first top cross bar 42, and bottom cross bar 44 are formed of a suitable metal, such as aluminum, steel, etc., so as to have sufficient strength to support gateway display fixture 12 (e.g., see FIG. 3). Each of upright members 40 extends substantially vertically spaced from the other of upright members 40, and in one example, is a rectangular tube. Each of upright members 40 defines an interior-facing surface 46, an exterior-facing surface 48, a front-facing surface 50, and a rear-facing surface 52. In one example, one or both of front-facing surface 50 and rear-facing surface 52 includes an array of slots 54 (for example, see the rear view of FIG. 5) for selectively and adjustably receiving at least certain types of auxiliary display components 14

Figure 10:
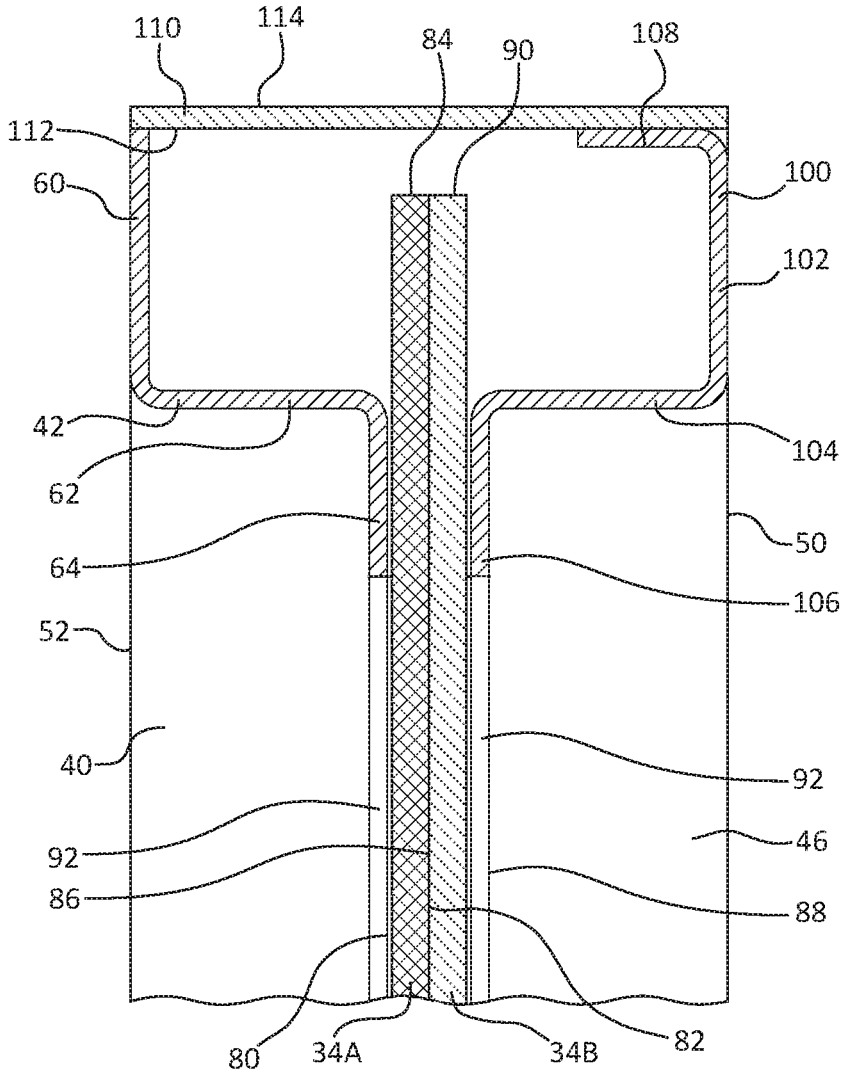
FIG. 10 is a cross-sectional view of the side display unit taken along the line X-X of FIG. 3, according to one embodiment of the present invention.

First top cross bar 42 extends between upright members 40 at or near a top of each upright member 40. In one example, first top cross bar 42 is coupled to the corresponding interior-facing surface 46 of each upright member 40 such that a top of first top cross bar 42 is substantially flush with a top of each upright member 40. While various cross-sections of first top cross bar 42 are suitable, in one example, first top cross bar 42 has a Z-shaped cross section including a first leg 60, an offset 62, and a second leg 64, as illustrated with additional reference to the cross-sectional view of FIG. 10. First leg 60 and second leg 64 extend substantially parallel to each other, and offset 62 extends substantially perpendicularly relative to each of first leg 60 and second leg 64, in one example. First top cross bar 42 is mounted to each upright member 40 such that a rear-facing surface of first leg 60 is positioned to be substantially coplanar with a rear-facing surface of each upright member 40. In this manner, second leg 64 extends substantially parallel to rear-facing surface of upright members 40 at a distance spaced from the rear-facing and front-facing surfaces thereof.

Bottom cross bar 44 is substantially tubular, in one embodiment, and extends between and is coupled to a corresponding interior-facing surface 46 of each of upright members 40. A bottom-facing surface of bottom cross bar 44 is positioned to be substantially coplanar with bottoms of upright members 40, in one example, while rear-facing and front-facing surfaces of bottom cross bar 44 are substantially coplanar with rear-facing and front-facing surfaces of upright members 40.

In one example, principle frame portion 36 additionally includes an intermediate cross bar 70, which extends parallel to each of first top cross bar 42 and bottom cross bar 44, and toe kick plates 72. Intermediate cross bar 70 has a smaller width than each of upright members 40 and extends between and is coupled to interior-facing surfaces 46 thereof. A top of a different one of toe kick plates 72 is coupled to intermediate cross bar 70 on either side thereof, and each toe kick plate 72 is sized and shaped to cover the opening formed between upright members 40, bottom cross bar 44, and intermediate cross bar 70. Toe kick plate 72 provides a robust panel coupled to principle frame portion configured to withstand repeated interaction with shopping carts, strollers, consumers, retail employees, etc. and extends to a height selected to minimize shopping cart, stroller, etc. interaction with panels 34 to help maintain the aesthetic appeal of gateway fixture 12 by decreasing damage to panels 34.

Panels 34 are sized and shaped to fit within and substantially cover an opening 78 extending through principle frame portion 36, that is, more specifically, formed between upright members 40, first top cross bar 42, and intermediate cross bar 70. In one example, two panels 34, such as a rear panel 34A and a front panel 34B are stacked face-to-face and collectively secured across opening 78 in a manner abutting each of upright members 40, first top cross bar 42, and intermediate cross bar 70. In one embodiment, rear and front panels 34A and 34B are substantially identical in form, while in other embodiments, rear and front panels 34A and 34B are formed of different materials. For example, rear panel 34A may be formed of a structurally strong material while front panel 34B is a more flexible and less rigid material, such as cardstock or paper, and vice versa. In one embodiment, one or both of rear and front panels 34A and 34B is a mirror and or otherwise has a mirrored primary out front-facing surface 88, as illustrated for front panel 34B in the figures.

Other panels 34 maybe formed of any suitable material and are selected to block open areas in gateway display fixture 12, but also to increase the aesthetic appeal of gateway display fixture 12 and/or provide consumers with information and/or marketing. In one example, exposed surfaces such as rear surface 80 of rear panel 34A and front-facing surface 88 of front panel 34B are treated in a color, texture, three-dimensional relief, etc. and/or are printed with graphics such as images or text related to the category, brand, product type, etc. associated with a particular area of a retail store pad demarked by the presence of gateway display fixture 12. Other treatments of panels 34 are also contemplated, for example, creating a hooked or slotted merchandisable panel 34, and will be apparent to those of skill in the art upon reading the present application.

In one embodiment, one panel 34 or rear and front panels 34A and 34B are placed to cover opening 78 such that perimeter edges 84 and 90 of rear panel 34A and front panel 34B are each placed immediately adjacent each of upright members 40, first top cross bar 42, and intermediate cross bar 70. Additionally turning to the detail view of FIG. 10, elongated side rails 92 are statically coupled to and extend along the length of interior-facing surfaces 46 of upright members 40 adjacent each side of panel(s) 34 to form a slot therebetween for receiving and selectively maintaining one or more corresponding panels 34, such as rear and front panels 34A and 34B.

Rear panel 34A is positioned to abut a forward-facing surface of second leg 64 of first top cross bar 42, according to one embodiment. In one example, primary frame 30 additionally includes a second top cross bar 100 that abuts a front-facing surface 88 of front panel 34B to further secure rear and front panels 34A and 34B in place covering opening 78. A variety of configurations are contemplated for second top cross bar 100. In one embodiment, second top cross bar 100 is substantially Z-shaped like first top cross bar 42 and includes a first leg 102, an offset 104, and a second leg 106, where first and second legs 102 and 106 are substantially parallel with each other and offset 104 may or may not be perpendicular to each of first and second legs 102 and 106. In one example, second top cross bar 100 is positioned such that first leg 102 has a front-facing surface substantially coplanar with front-facing surface 50 of upright member 40 a rear-facing surface of second leg 106 is placed to abut front-facing surface 88 of front panel 34B.

As shown in the illustrations, second top cross bar 100 may also include a return leg 108 extending rearwardly from a top of first leg 102. Principle frame portion 36 further includes a cap plate 110 sized and shaped to fit across a top of each of upright member 40, first top cross bar 42 and second top cross bar 100 providing a planar and finished top surface 114 to primary frame 30. In one example, a bottom surface 112 of cap plate 110 abuts a top surface of return leg 108 as well as top edges of upright members 40 and first top cross bar 42. In one example, since first top cross bar 42 and second top cross bar 100 work in concert to hold panels 34 in place with one on the front and one on the back of panel 34, first top cross bar 42 is considered the front top cross bar and the section top cross bar 100 is considered the rear top cross bar. The various components of principle frame portion 36 are coupled to one another in any suitable manner such as by welding, adhesive, fasteners (e.g., see fasteners 116, as specifically described above), etc.

Auxiliary frame portion 38 is coupled to extend in line with principle frame portion 36 extending the width, but not substantially extending the thickness of principle frame portion 36. More specifically, in one embodiment, auxiliary frame portion 38 includes a vertical member 120, a top cross member 122, a bottom cross member 124, and an auxiliary cap plate 126. In one example, top cross member 122 and bottom cross member 124 are each formed as tubes, channels, or other suitable member. Auxiliary frame portion 38 components are formed of a suitable metal, such as aluminum, steel, etc. so as to have sufficient strength to support gateway display fixture 12, in one embodiment. Bottom cross member 124 is coupled with exterior-facing surface 48 of one of upright members 40 of principle frame portion 36, for example, such that a bottommost surface of bottom cross member 124 is positioned to extending substantially coplanar with a bottommost surface of bottom cross bar 44 of principle frame portion 36. Similarly, top cross member 122 is coupled with the same exterior-facing surface 48 of the same upright member 40 of principle frame portion 36, for example, such that a topmost surface of top cross member 122 is positioned to extend substantially coplanar with a topmost surface of top cross bar 42 of principle frame portion 36.

Vertical member 120, which, in one embodiment, is a tube, channel, or other suitable member, has a height substantially identical to each of upright members 40 and extends substantially parallel to each of upright members 40, in one example. Vertical member 120 defines an interior-facing surface 128, an exterior-facing surface 130 opposite interior-facing surface 128, a front-facing surface 132, and a rear-facing surface 134. Interior-facing surface 128 abuts ends of each of top cross member 122 and bottom cross member 124 opposite principle frame portion 36 and is coupled thereto in a suitable manner. An open window 136 is formed by auxiliary frame portion 38 between vertical member 120 and the closest upright member 40 of principle frame portion 36, top cross member 122, and bottom cross member 124. Open window 136 improves sightlines around gateway display 12 to visually perceive merchandise for sale and/or defines an area as being for a particular purpose while not entirely blocking the area from view to encourage consumer entry into the corresponding area.

Cap plate 126 is sized and shaped to cover vertical member 120 and top cross member 122 to provide a clean planar top surface 138, which, in one embodiment, is substantially coplanar with top surface 114 of cap plate 110 of principle frame portion 36. Cap plate 126 additionally includes two apertures 142 (generally indicated in FIGS. 9 and 11) spaced from one another a distance more than half and, in one embodiment, more that three-quarters of a distance equal to an overall width of auxiliary frame portion 38.

Figure 11:
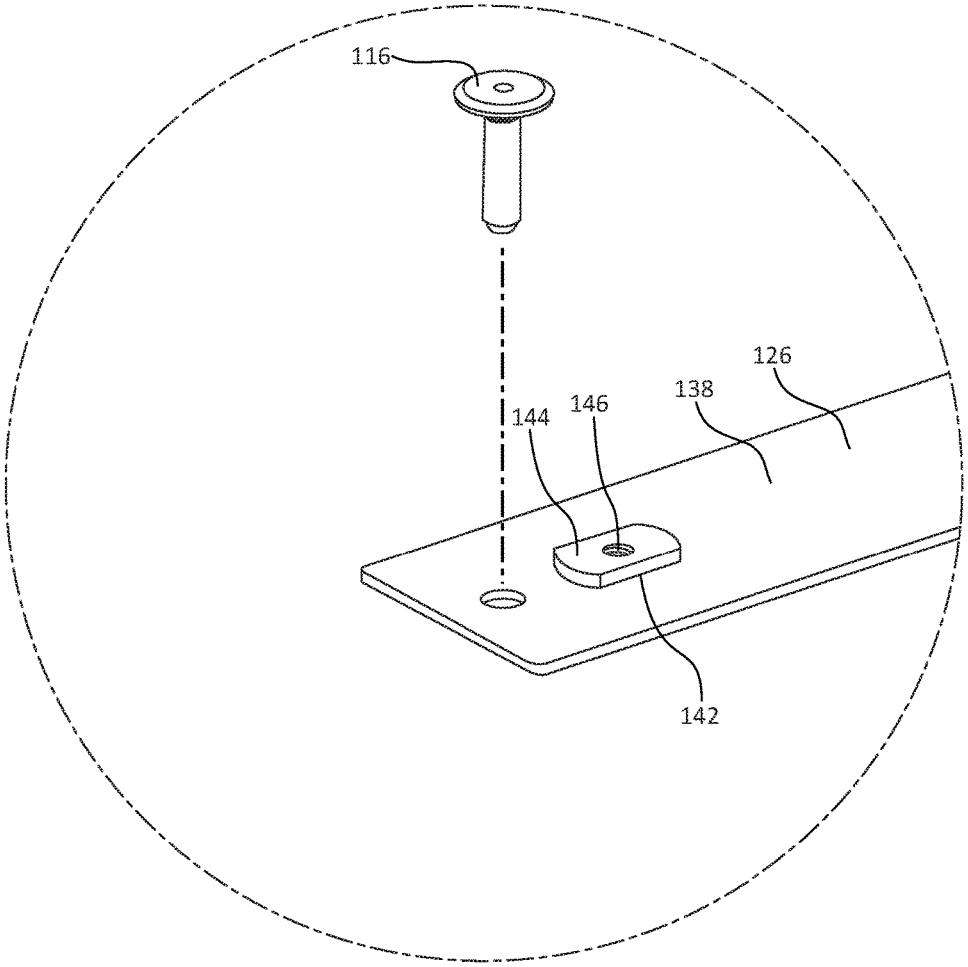
FIG. 11 is a detail view of portion of the side display unit taken along the boundary line indicated in FIG. 9, according to one embodiment of the present invention.

A weldnut 144 is applied above each of the two apertures 142 via welding and includes a threaded cavity 146 therethrough that aligns with one of two apertures 142, as shown with additional reference to the detail of FIG. 11. Weldnut 144 provides threaded cavity 146 such that weldnut 144 acts like a statically secured nut, such that no separate nut is needed to receive a coupling bolt or similar. The various components of auxiliary frame portion 38 are coupled to one another and to principle frame portion 36 in any suitable manner such as by welding, adhesive, fasteners (e.g., see fasteners 116, as specifically described above), etc.

In one embodiment, a stand is coupled with and/or formed integrally with primary frame 30, such that primary frame 30 is able to freely stand vertically on a floor (not shown) substantially without additional support. In the embodiments illustrated, side display unit 18 includes footed supports 32 coupled with each primary frame 30. Each footed support 32 includes footplates 150 and an intermediate plate 152, which are each formed of a planar material in an elongated rectangular shape. In one example, footplates 150 and intermediate plate 152 collectively arranged in an I-shape with two footplates 150 extending substantially parallel to one another and intermediate plate 152 extending substantially perpendicularly and transversely centered relative to each of footplates 150. According to one embodiment, footplates 150 and intermediate plate 152 are formed from a similar thickness material such that they collectively define a bottom surface 154 and a top surface 156, which, in one example, are each substantially planar.

In one example the overall width of footed support 32 is substantially equal to an overall width of primary frame 30, with an overall depth of intermediate plate 152 being substantially identical to, just smaller than, or just larger than a bottom footprint of primary frame 30. An overall depth of footed support 32, and therefor of footplates 150 is dependent upon the overall size of primary frame 30 to prevent tipping of primary frame 30, which is generally held in a substantially vertically extending orientation, even if primary frame 30 is impacted by a shopping cart, stroller, consumer, child, stocking cart, employee, etc. (not shown), while maintaining a low profile to avoid being an obstacle for individuals as they move around gateway display fixture 12. Footed support 32 includes pads 168 of any suitable nature, as will be apparent to those of skill in the art upon reading this application, on bottom surface 154 of footplates 150 and/or intermediate plate 152, in one embodiment.

Footed support 32 is coupled with primary frame 30 in any suitable manner, and in one example, is coupled with primary frame 30 via two or more, for example, three coupling channels 158 each facing inwardly. For instance, each coupling channel 158 is sized just slightly larger than a corresponding one of vertical member 120 or upright members 40 such that vertical member 120 or an upright member 40 can slide into the opening of coupling channel 158. A coupling channel 158 is welded or otherwise statically secured to top surface 192 of each footplate 150 in a centered positioned aligned with intermediate plate 152 and facing toward the other footplate 150. In one example, each coupling channel 158 is aligned with an outermost edge of each footplate 150. Primary frame 30 is received by coupling channels 158 by sliding bottom portions of vertical member 120 and upright member 40 into the two outside coupling channels 158 and securing the same with fasteners 116 thread through holes 160 of coupling channels 158 and corresponding and aligned holes 162 in vertical member 120 and upright member 40.

In one embodiment, an additional or alternative coupling channel 158 is coupled to intermediate plate 152 about mid-span to align with and receive upright member 40 coupled to auxiliary frame portion 38. In this embodiment, a slot (not shown) is formed through bottom cross member 124 top receiving coupling channel 158 such that the upright member 40 coupled to auxiliary frame portion 28 can be slid into the mid-span coupling channel 158 and secured via fasteners 116 or other suitable coupling agent as described above for other coupling channels 158.

Figure 12:
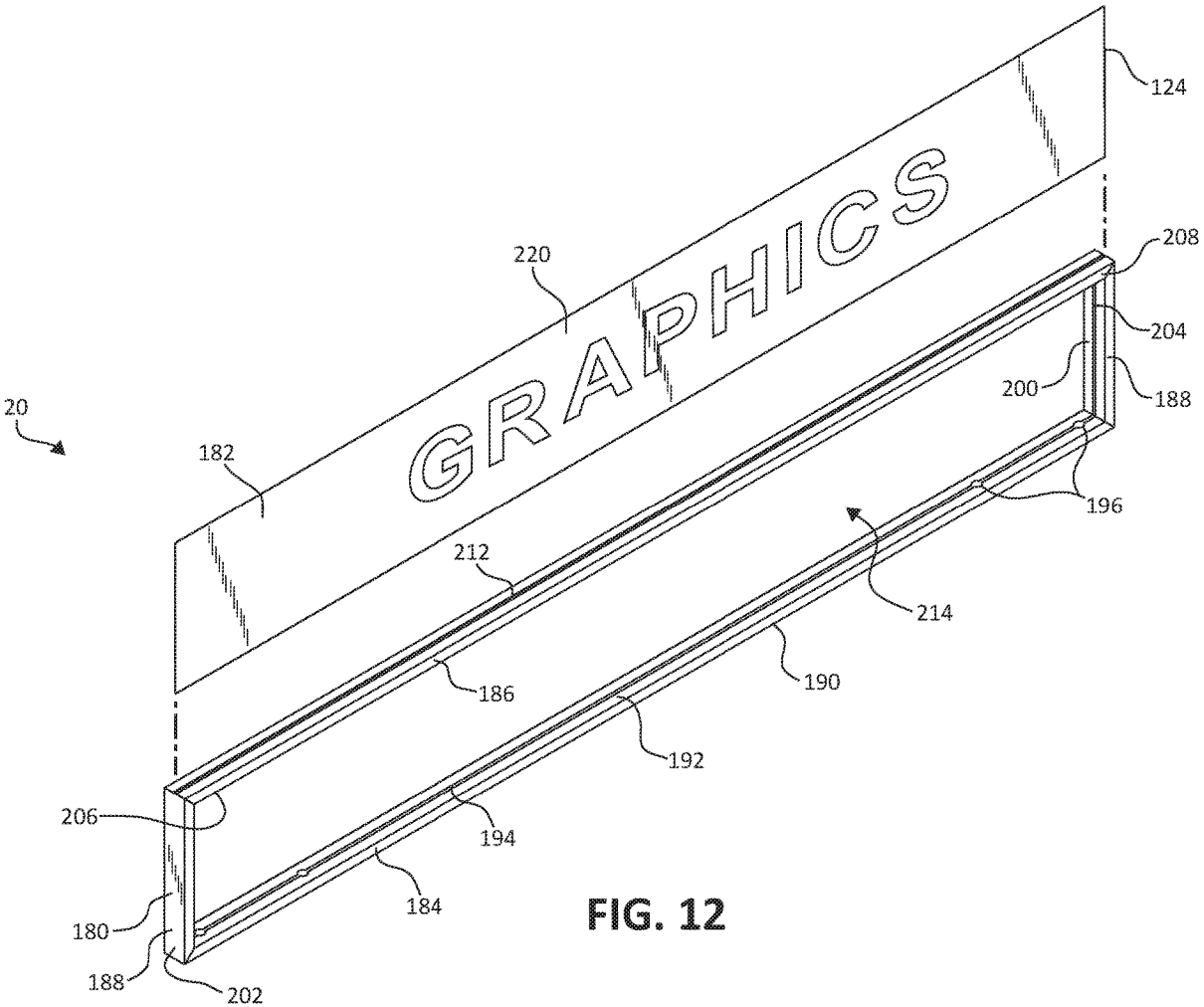
FIG. 12 is a front perspective view illustration of the transom display unit of the display fixture of FIG. 3, according to one embodiment of the present invention.

Referring to FIG. 12, transom display unit 20 includes a transom frame 180 and a panel 182, in one example. Transom frame 180 is substantially rectangular in one embodiment; however, other overall shapes for transom frame 180 are also contemplated. Transom frame 180 includes a bottom segment 184, a top segment 186 opposite and extending substantially parallel to bottom segment 184, and two side segments 188 each extending between opposing ends of bottom segment 184 and top segment 186, according to one embodiment, forming a void 214 therebetween. Each of bottom segment 184, top segment 186, and side segments 188 are substantially tubular and are coupled end to end. In one embodiment, the components of transom fame 180 are formed of a suitable metal, such as aluminum, steel, etc. as a means for providing sufficient strength to support gateway display fixture 12 use.

Figure 13:
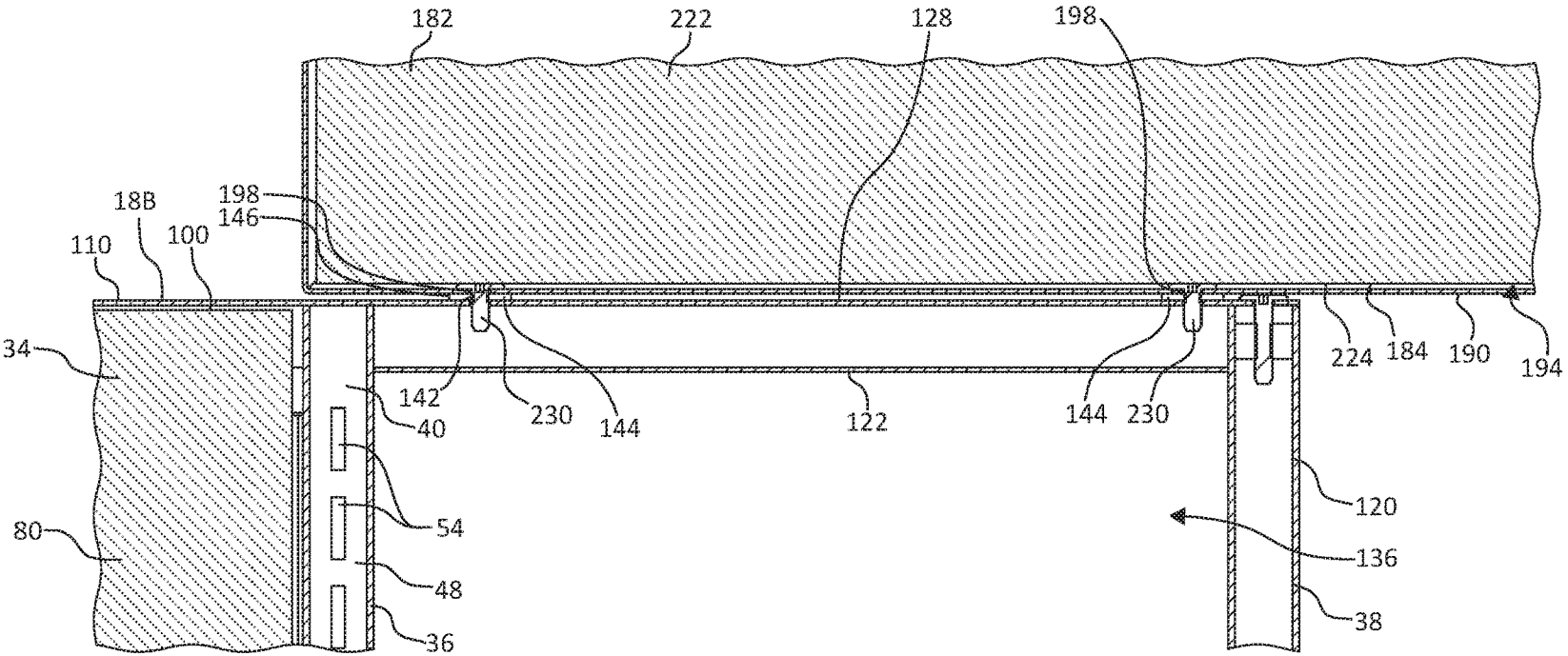
FIG. 13 is a cross-sectional view of the display fixture taken along the line Y-Y in FIG. 7, according to one embodiment of the present invention.
Figure 14:
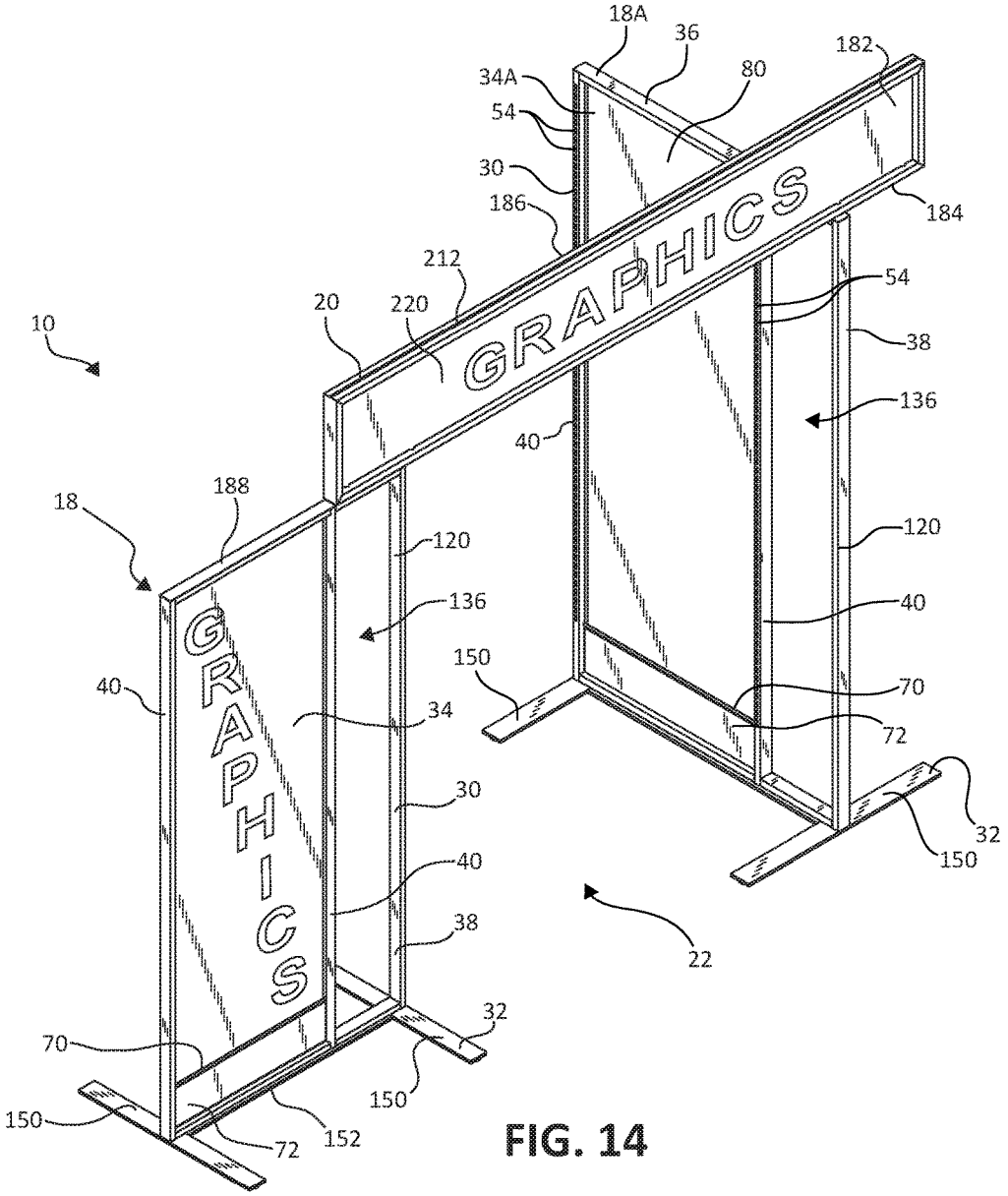
FIG. 14 is a front perspective view illustration of a display fixture of the retail display of FIG. 2 in a non-linear configuration, according to one embodiment of the present invention.
Figure 15:
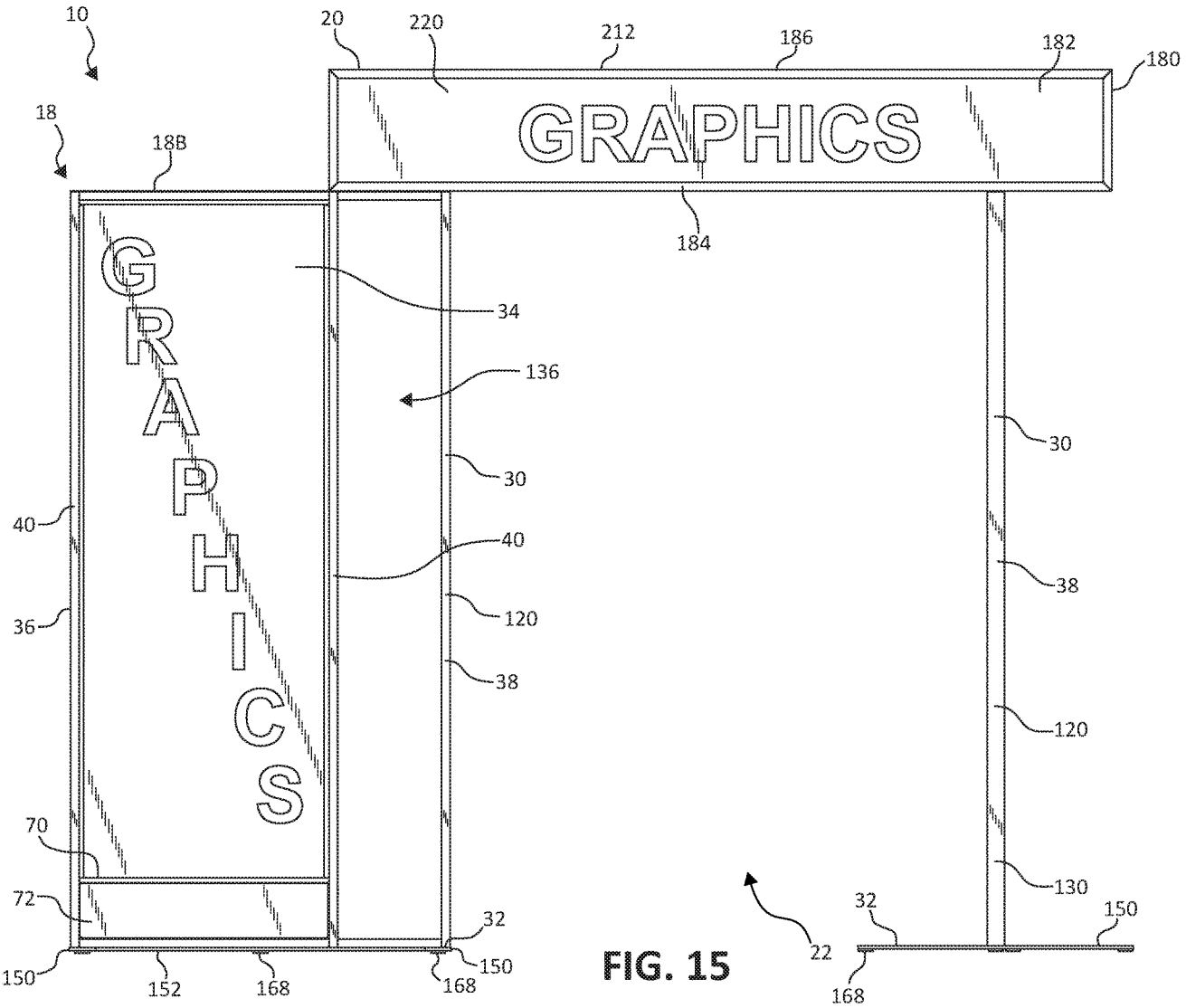
FIG. 15 is a front view illustration of the display fixture of FIG. 14, according to one embodiment of the present invention.
Figure 16:
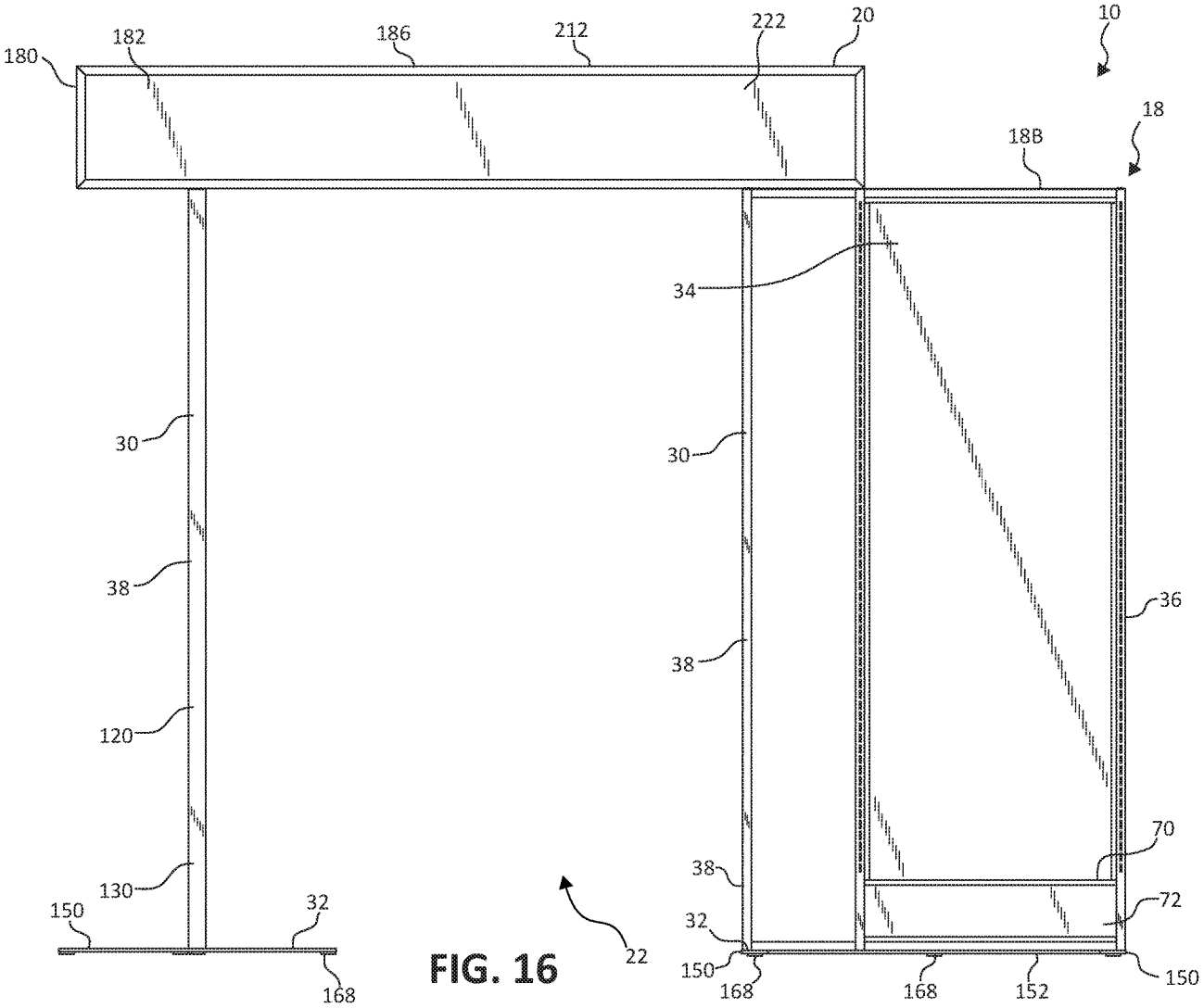
FIG. 16 is a rear view illustration of the display fixture of FIG. 14, according to one embodiment of the present invention.
Figure 17:
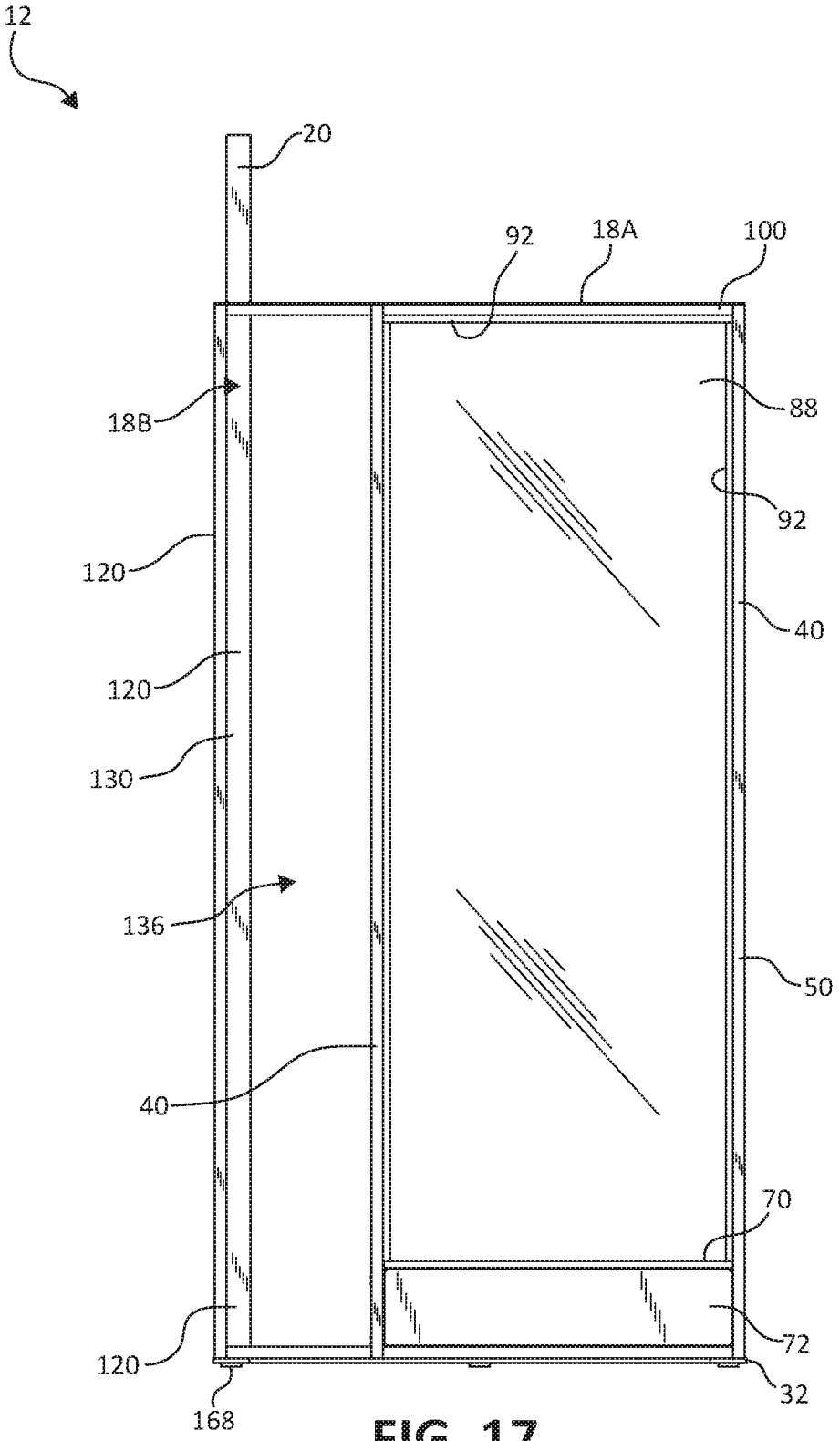
FIG. 17 is a right side view illustration of the display fixture of FIG. 14, according to one embodiment of the present invention.
Figure 18:
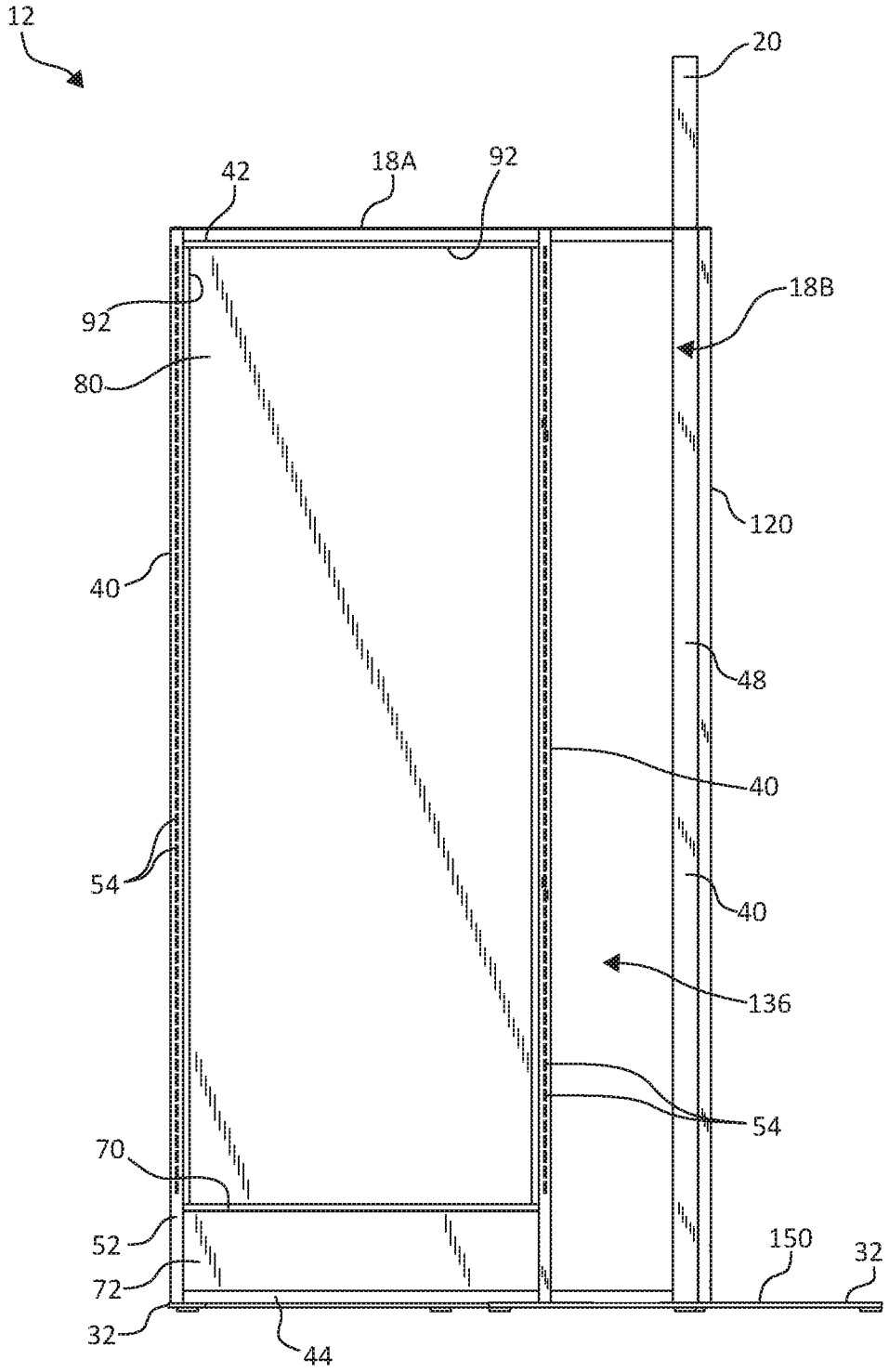
FIG. 18 is a left side view illustration of the display fixture of FIG. 14, according to one embodiment of the present invention.
Figure 19:
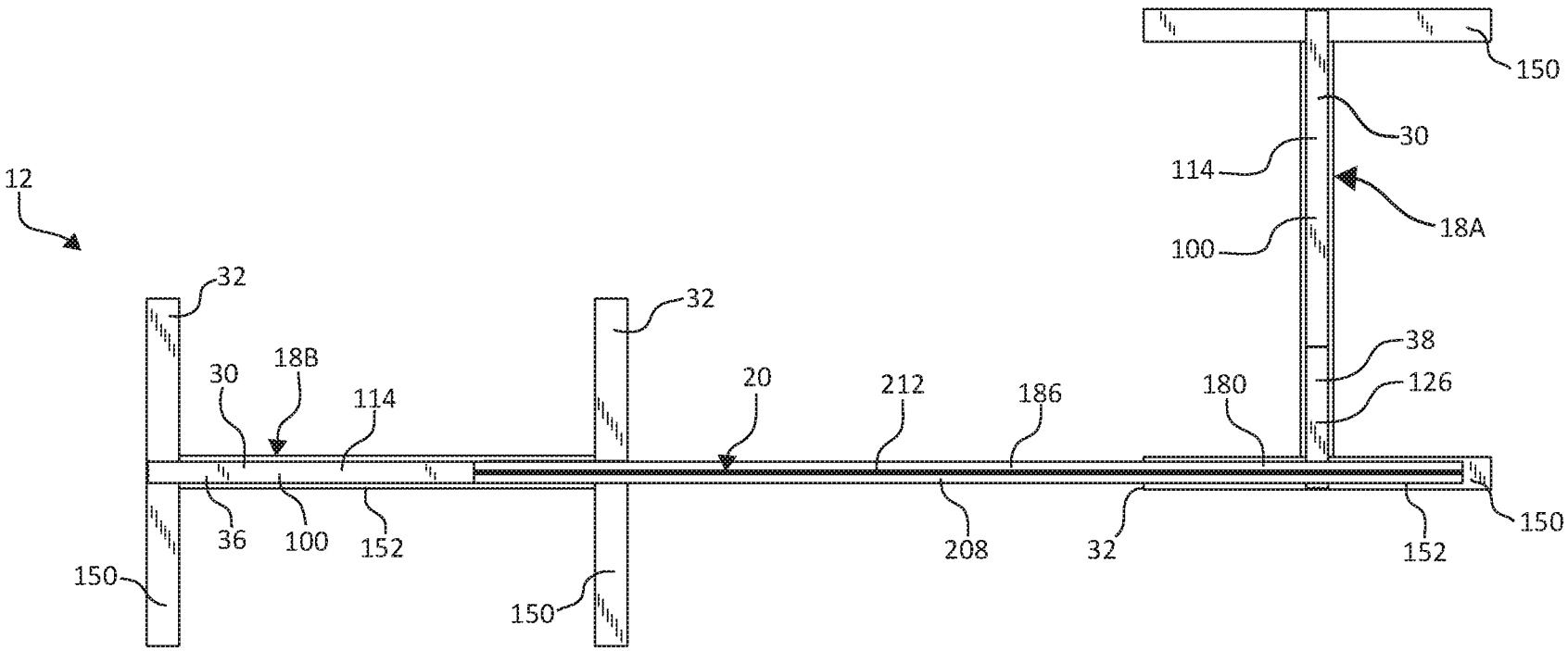
FIG. 19 is a top view illustration of the display fixture of FIG. 14, according to one embodiment of the present invention.
Figure 20:
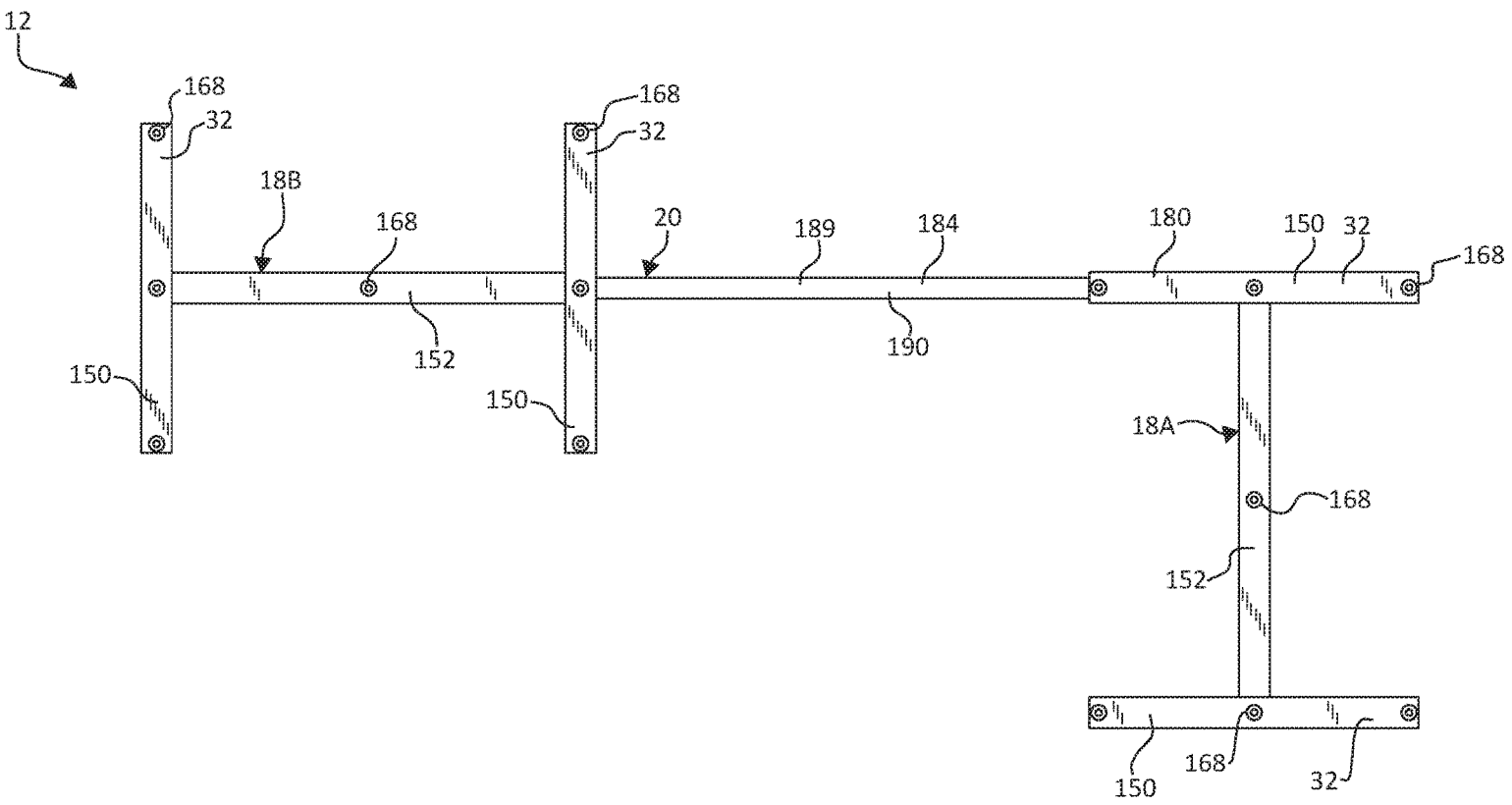
FIG. 20 is a bottom view illustration of the display fixture of FIG. 14, according to one embodiment of the present invention.
Figure 21A:
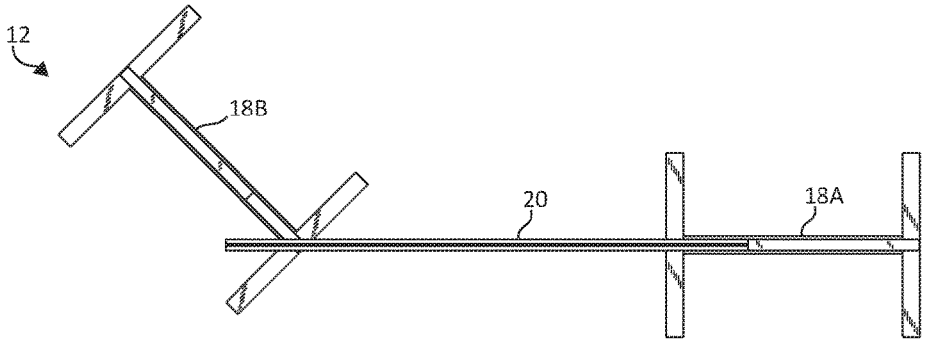
FIGS. 21A-21D are each top view illustrations of a display fixture in different configurations, according to one embodiment of the present invention.
Figure 21B:
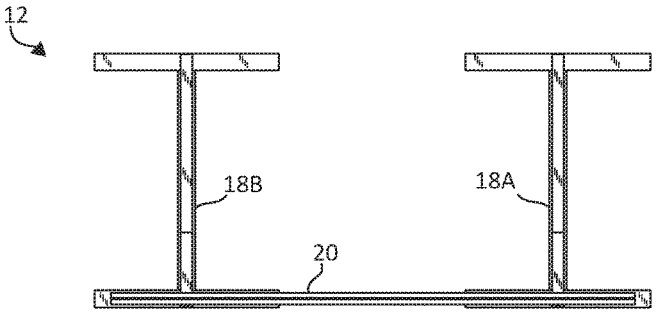
Figure 21C:
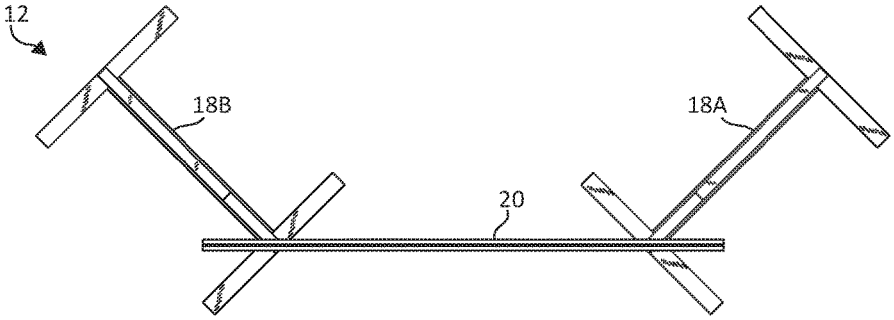
Figure 21D:
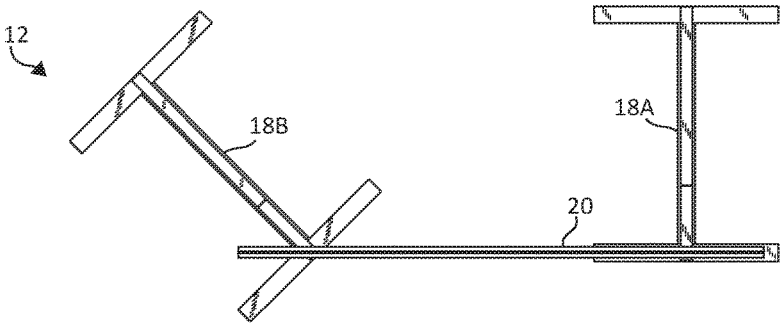
Figure 22A:
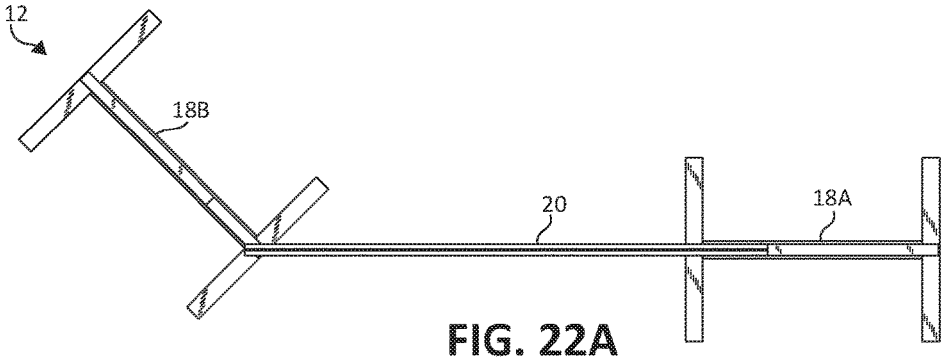
FIGS. 22A-22F are each top view illustrations of a display fixture in different configurations, according to one embodiment of the present invention.
Figure 22B:
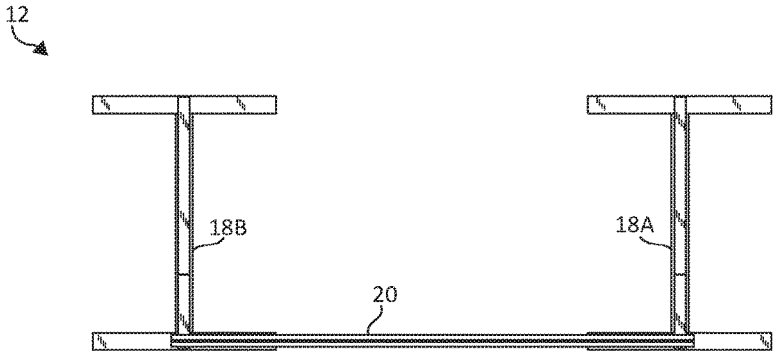
Figure 22C:
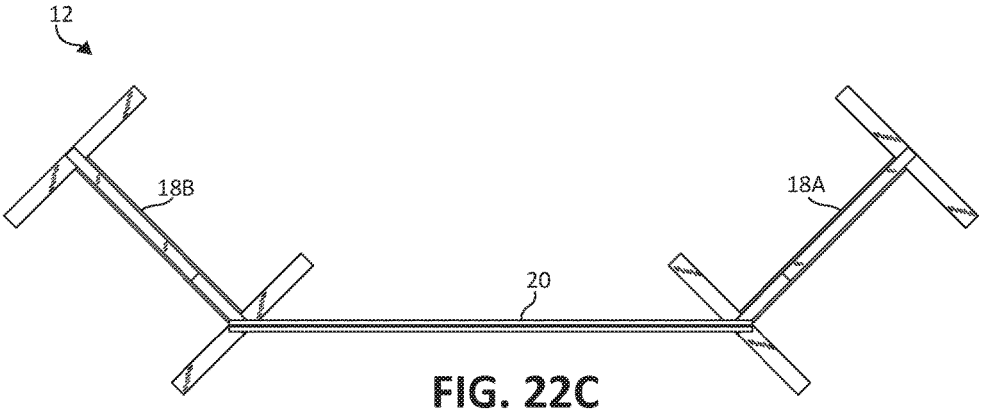
Figure 22D:
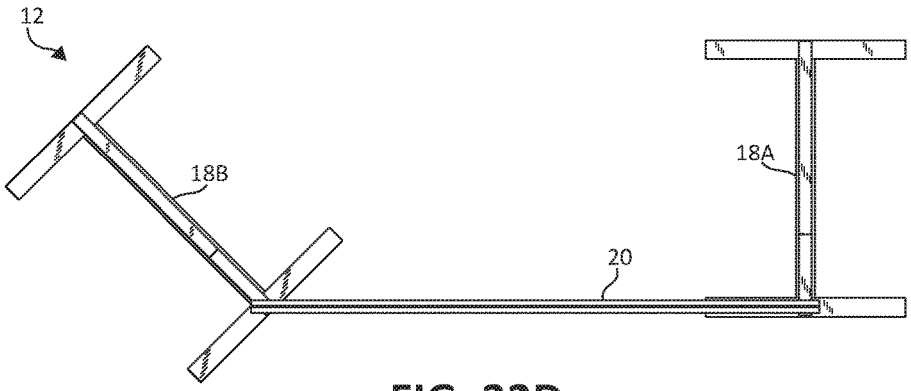
Figure 22E:
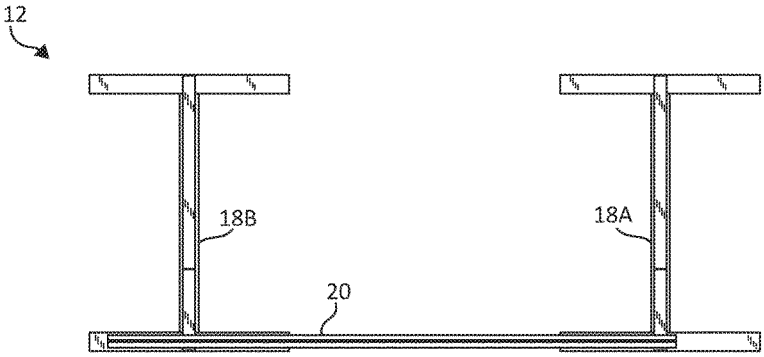
Figure 22F:
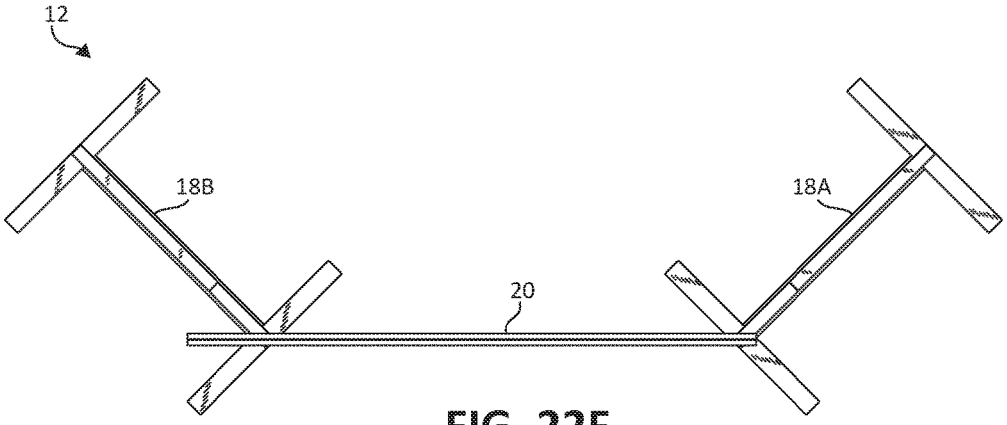

Bottom segment 184 of transom frame 180 defines a bottommost surface 190 and an opposite top surface 192. Bottommost surface 190 (see, e.g., FIG. 8) is substantially continuous and planar other than two pairs of apertures 198 (see FIG. 13), which are spaced along a length of bottom segment 184, each pair of apertures 198 being near an different end of bottom segment 184. Each aperture 198 in a pair being spaced from the other apertures 198 in the pair a distance substantially identical to the spacing of apertures 142 in a, cap plate 126 of primary frame 30 and, therefore, to the spacing of threaded cavities 146 of weldnuts 144.

Top surface 192 of bottom segment 184 additionally includes a top slot 194 extending along a substantial entirety of a length of bottom segment 184 through a center of top surface 192. Top slot 194 is sized with a width and length to selectively receive a bottom length of a perimeter edge 224 of panel 182 therein. In one example, cutouts 196 are formed at various positions along top slot 194, widening top slot 194 at discrete points. Cutouts 196 provide wider pass-through clearance than top slot 194 alone, which allow fasteners 230, such as bolts or similar, to be inserted through top slot 194 via cutouts 196 into an interior of bottom segment 184, and through apertures 198 through bottommost surface 190 thereof, as shown, for example, in the cross-sectional view of FIG. 13.

Returning to FIG. 12, each of side segments 188 extends upwardly from opposing ends of bottom segment 184 to top segment 186, for example, in a substantially linear manner. Each of side segments 188 has a height corresponding with a height of panel 182, and defines an elongated side slot 204 extending along a length of each side segment 188 and configured to receive side portions of perimeter edge 224 of panel 182. Each elongated side slot 204 aligns with top slot 194 in bottom segment 184 such that perimeter edge 224 of substantially planar panel 182 can simultaneously be received in both elongated side slots 204 and top slot 194.

Top segment 186 of transom frame 180 extends between top ends of side segments 188 opposite bottom segment 184 and has an overall shape and length substantially identical to bottom segment 184. In one embodiment, top segment 186 defines a bottom surface 206 facing bottom segment 184 and a top surface 208 facing away from bottom segment 184, an elongated slot 212 is formed through an entire thickness of top segment 186, that is, through both bottom surface 206 and top surface 208. Slot 212 is sized to receive panel 182 in a manner that allows panel 182 to slide through top segment 186 to interact with interior portions of side segments 188 and bottom segment 184. In this manner, slot 212 is aligned with elongated side slots 204 such that perimeter edge 224 of panel 182 is simultaneously maintained within elongated side slots 204 in side segments 188, top slot 194 in bottom segment 184, and at least the portion of elongated slot 212 formed through bottom surface 206 of top segment 186.

Panel 182 is another one of panels 34 and is formed similarly to rear and front panels 34A and 34B. Panel 182 is sized and shaped to fit within and substantially cover an opening 214 extending through transom display unit 20, more particularly, between bottom segment 184, top segment 186, and side segments 188. In one example, two panels (not shown), such as a rear panel and a front panel are stacked face-to-face and collectively secured across opening 214 in a manner abutting each of bottom segment 184, top segment 186, and side segments 188.

In one embodiment, panel 182 is formed of any suitable material and is selected to block opening 214 in gateway display fixture 12, but also to increase the aesthetic appeal of gateway display fixture 12 and/or provide consumer with information and/or marketing. In one example, exposed surfaces such as a front surface 220 and/or a rear surface 222 of panel 182 are treated in a color, texture, three-dimensional relief, etc. and/or are printed with graphics such as images or text related to the category, brand, product type, etc. associated with a particular area of a retail store pad demarked by the presence of gateway fixture 12. Other treatments of panel 182 are also contemplated and will be apparent to those of skill in the art upon reading the present application.

Once both side display units 18A and 18B and transom display unit 20 are separately assembled as described above, they are assembled with one another to form gateway display fixture 12, wherein transom display unit 20 sits on top of and extends between first side display unit 18A and second side display unit 18B to form the opening or walkway 22 below transom display unit 20 and between side display units 18. In one embodiment, as illustrated in FIGS. 1 and 3-8, gateway display fixture 12 is formed in a generally planar or straight-line configuration in which, all of upright members 40 and vertical members 120 generally align with each other on a front side and/or backside thereof. According to one example, in this configuration, each of side display units 18 is coupled with transom frame 180 at two points prior to placing panel 182 in transom frame 180. More specifically, as shown in the detail view of FIG. 13 for second side display unit 18B, the pair of apertures 198 at one end of transom frame 180 of second side display unit 18B are each aligned with one of two threaded cavities 146 of cap plate 126 of primary frame 30. In one example, in all configurations, transom frame 180 and transom display unit 20 as a whole only is coupled to primary frame 30 via and/or only contacts auxiliary frame portion 38 of each of first display unit 18A and second display unit 18B and is not coupled with and/or does not contact principle frame portion 26.

Fasteners 230 are moved through top slot 194 via cutouts 196, and through apertures 198 to interface with a threaded cavity 146. Rotation of fastener 230 secures fastener 230 in threaded cavity 146, thereby, coupling transom frame 180 with primary frame 30, without the need for addition nuts or other hardware due to inclusion of weldnut 144 with threaded cavity 146 built into primary frame 30. First side display unit 18A is similarly coupled with transom frame 180 on the opposite end of transom frame 180. In this manner, transom frame 180 extends over and bridges the walkway 22 between first side display unit 18A and second side display unit 18B. Once side display units 18 are coupled with transom frame, panel 182 is slid into transom frame via slot 212 through top surface 208 to cover void 214 defined within transom frame 180 such that perimeter edge 224 is simultaneously maintained within the various slots 194, 204, and 212 of transom frame 180.

The two-point coupling of each side display unit 18 to transom frame 180 is particularly advantageous where the resulting gateway display fixture 12 is in a straight line configuration, as the two-point coupling provides a more robust coupling less likely to tip or otherwise be inadvertently destroyed via consumer, employee, or other interaction with gateway display fixture 12. In another embodiment, one-point or additional point coupling of transom frame 180 to side display units 18 is used. Notably, the fewer point coupling used, the easier it is to convert gateway display fixture 12 to other configurations, as will be further described below, while too few of point couplings may not provide the stability desired depending upon the dimensions and/or other features of the gateway display fixture 12. In one embodiment, at least one of fasteners 230 is static and serves as an axis point for rotating one of side display units 18 relative to transom display unit 20 while the one of the side display units 18 remains coupled with the transom display unit 20. In other embodiments, fasteners 230 are removed from side display units 18 to allow for repositioning of side display units 18 relative to transom display unit 20 before being recoupled with side display units 18 to selectively hold gateway display fixture 12 in the selected configuration.

In other configurations of gateway fixture 12, in which one or both of side display units 18 are rotated out of plane and/or out of the substantially linear configuration with transom frame 180, such as the configuration illustrated in FIGS. 14-20, the angled side display unit 18, in this case first side display unit 18A is coupled to transom frame 180 in a single-point coupling between an innermost one a first pair of apertures 198 and an outmost one of threaded cavities 144 of first side display unit 18A. In this configuration, the turned angle of first side display unit 18A and its footed support 32 thereof relative to second side display unit 18B and its footed support 32 provides gateway display fixture 12 with additional front-to-back stability. As such, a single point coupling of transom frame 180 with first side display unit 18A provides suitable stability for gateway display fixture 12. A great variety of configurations of gateway fixture 12 are contemplated in which at least one of a first end pair of apertures 198 of transom frame 180 is coupled to at least one of threaded cavities 144 of first side display unit 18A and at least one of a second, opposite, end pair of apertures 198 of transom frame 180 is coupled to at least one of threaded cavities 144 of second side display unit 18B. In this manner, gateway fixture 12 can be reconfigured by changing the angle orientation of one or both of side display units 18 relative to transom display unit 20 and/or which of the apertures 198 couple with different ones of the threaded cavities.

In each of the configurations shown in FIGS. 21A-21D, which are provided as illustrations only, not an exhaustive list of possible configurations, one or two of first side display unit 18A and second side display unit 18B are angled relative to and coupled to transom frame 180 via the interior most one of each pair of apertures 198 in transom frame 180. Additional configurations are also contemplated where one or more of first side display unit 18A and second side display unit 18B is coupled to transom frame 180 via the exterior most one of each pair of apertures 198 in transom frame 180 as shown in the example configurations of FIGS. 22A-22F. Other configurations can be formed using one of the configurations of first side display unit 18A relative to transom display unit 20 with any other ones of the configuration as shown for second side display unit 18B. In addition, while in the illustrated examples, side display units 18 are generally shown in one of an about 180° inside angle, an about 135° inside angle, and an about 90° inside angle relative to transom frame 180, other angled orientations are also contemplated such as inside angles between about 90° degrees and about 270° degrees relative to transom frame 180. Still further, while the example configurations shown in FIGS. 21A-21D and 22A-22F, both side display units 18 generally extend to the same side of transom display unit 20, in other examples, first side display unit 18A may extend to a front or back side of transom display unit 20 while second side display unit 18B may extend to the other of the front or back side of transom display unit 20.

The variety of configurations available and the ability to repeatedly reconfigure each gateway display fixture 12 by rotating and or sliding each side display unit 18 relative to transom display unit 20 allows for a number of the same gateway display fixtures 12 to be used on a single retail pad while still varying the presentation of the gateway display fixtures 12 relative to each other a sufficient amount to retain an interesting and pleasing aesthetic for guests, encouraging them to peruse a larger amount of the retail pad and the merchandise presented thereon. In addition, the variety of configurations of gateway display fixtures 12 make it adaptable for use with different categories, brands, merchandise types, etc. and in various sized and shaped spaces. The adaptability of the gateway display fixtures 12 decreases the need to retain an inventory of as many different types of fixtures at a single retail setting.

In addition, gateway display fixture 12 is further configurable for use with various auxiliary components 14, for example as illustrated in FIGS. 1 and 2. In one embodiment, platforms 300 and/or mannequins 302 are readily placed and positioned to accentuate gateway display fixture 12 and/or modify the overall presentation of retail display 10. In one example, hang bars 304, shelves 306, face-out bars (not shown), pegs (not shown) or other hooked components configured to selectively couple with upright members 40 via the array of slots 54 formed on rear-facing surfaces 52 thereof, allowing each side display unit 18 to be configured in numerous configurations to support any number of sizes, shape, and kind of merchandise 16. In one embodiment, for example, as generally illustrated in the figures, only rear-facing surface 52 of upright members 40 includes an array of slots 54, while in other embodiments both of rear-facing surface 52 and front-facing surface 50 including similar array of slots and/or only front-facing surface 50 includes an array of slots (not shown).

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A gateway display fixture comprising:

a first side display unit including two threaded cavities along a top surface of the first side display unit, wherein the first side display unit extends substantially vertically away from a floor;

a second side display unit extending substantially vertically away from the floor to a top surface of the second side display unit, the second side display unit being laterally spaced from the first side display unit; and a transom display unit selectively coupled with each of the first side display unit and the second side display unit to form a walkable pathway under the transom display unit between the first side display unit and the second side display unit, the transom display unit including a bottom segment having a first pair of coupling apertures near a first end of the bottom segment;

wherein the display fixture is adjustable between a first configuration and a second configuration, in the first configuration, the first side display unit extends substantially in line with the transom display unit and is coupled to the transom display unit via two fasteners each extending through a different one of the first pair of coupling apertures and a different one of the two threaded cavities, and in the second configuration, the first side display unit is rotated out of line with the transom display unit and is coupled to the transom display unit via a single fastener extending through only one of the first pair of coupling apertures and only one of the two threaded cavities.

2. The gateway display fixture of claim 1, wherein:

the bottom segment of the transom display unit includes a second pair of coupling apertures near a second end of the bottom segment opposite the first end of the bottom segment, the second side display unit includes a second two threaded cavities along a top surface of the second side display unit, and at least one second fastener is secured to at least one of the second two threaded cavities through at least one of the second pair of coupling apertures to selectively secure the second side display unit to the transom display unit.

3. The gateway display fixture of claim 2, wherein in the first configuration of the display fixture, the at least one second fastener is two second fasteners and each of the second fasteners is secured to a different one of the second two threaded cavities via a different one of the second pair of coupling apertures such that the second side display unit extends in line with the first side display unit and the transom display unit.

4. The gateway display fixture of claim 3, wherein in the second configuration of the display fixture, the at least one second fastener is a single second fastener secured to one of the second two threaded cavities via one of the second pair of coupling apertures such that the second side display unit extends with an angled orientation relative to the transom display unit.

5. The gateway display fixture of claim 1, wherein:

the transom display unit includes a transom frame and a panel, the transom frame includes the bottom segment, a top segment opposite the bottom segment, and side segments extending between the top segment and the bottom segment to define an opening between the top segment, the bottom segment, and the side segment, the transom frame defining a slot extending entirely through the top segment and through interior-facing surfaces of each of the side segments and the bottom segment, and the panel extends across the opening and defines a perimeter edge that is received in the slot adjacent each of the top segment, the bottom segment, and the side segments.

6. The gateway display fixture of claim 5, wherein:

the bottom segment includes a bottom surface opposite the interior-facing surface of the bottom segment, the first pair of coupling apertures each extend through the bottom surface, the slot terminates before extending through the bottom surface, and the interior-facing surface of the bottom segment includes a different cutout immediately adjacent the slot providing a wider pass-through for inserting each the two fasteners through the slot and into one of the first pair of coupling apertures.

7. The gateway display fixture of claim 1, wherein:

the first side display unit includes a primary frame and a footed support, the primary frame including the top surface and the two threaded cavities, and the footed support is coupled to the primary frame opposite the top surface of the primary frame and includes two footplates transversely extending relative to the primary frame to support the first side display unit on the floor.

8. The gateway display fixture of claim 7, wherein:

the footed support includes coupling channels extending vertically upwardly from the two footplates, the primary frame includes two upright members each extending along a substantial entirety of the overall height of the primary frame, and each of the two upright members is received within and secured to a different one of the coupling channels of the footed support.

9. The gateway display fixture of claim 1, wherein:

the first side display unit includes a principle frame portion and an auxiliary frame portion, the principle frame portion includes two upright members, a top cross bar, and a bottom cross bar collectively defining an opening therebetween, and a panel maintained within and substantially covering the opening, the auxiliary frame portion extends from one of the two upright members in a direction opposite the other one of the two upright members and has a height substantially equal to a height of the principle frame portion, the auxiliary frame portion includes a vertical member spaced from the one of the two upright members and a second top cross bar extending from the one of the two upright members to the vertical member, and the two threaded cavities are each formed in a top surface of the auxiliary frame portion.

10. The gateway display fixture of claim 9, wherein the transom display unit is only coupled with the first display unit via the auxiliary frame portion of the first side display unit.

11. The gateway display fixture of claim 9, wherein an open window is defined between the one of the two upright members and the vertical member.

12. The gateway display fixture of claim 9, wherein:

the first side display unit includes an intermediate cross bar and a toe kick plate, the intermediate cross bar extends from one of the two upright members to the other of the two upright members and is positioned between the top cross bar and the bottom cross bar, the toe kick plate extends between and is positioned adjacent to each of the bottom cross bar, the intermediate cross bar, and the two upright members.

13. The gateway display fixture of claim 1, wherein:

the first side display unit includes two upright members, a front top cross bar, a rear top cross bar, and a panel maintained between and covering an opening between the two upright members, the rear top cross bar extends between the two upright members and has a Z-shaped cross section defining a rear first leg aligned with a rear-facing surface of each of the two upright members, an rear offset forwardly extending from a bottom of the rear first leg, and a rear second leg extending downwardly from the rear offset opposite the rear first leg, the front top cross bar extends between the two upright members and has a Z-shaped cross section defining a front first leg aligned with a front-facing surface of each of the two upright members, an front offset extending rearwardly from a bottom of the front first leg, and a front second leg extending downwardly from the front offset opposite the front first leg, and the panel defines a first edge that is maintained between the rear second leg and the rear first leg.

14. The gateway display fixture of claim 1, wherein:

the first side display unit includes two upright members and a panel maintained between and covering an opening between the two upright members, each of the two upright members defines a rear-facing surface and includes an array of vertically extending slots along the rear facing surface, the display fixture further includes auxiliary display components coupled to the first side display unit via the array of vertically extending slots, and each of the auxiliary display components is configured to support merchandise.

15. The gateway display fixture of claim 1, wherein:

the first side display unit includes two upright members and a panel maintained between and covering an opening between the two upright members, and the panel includes a mirrored primary surface.

16. The gateway display fixture of claim 1, wherein the first display unit and the second display unit are substantially identical.

17. A retail display comprising:

a gateway display fixture including:

a first side display unit including two threaded cavities along a top surface of the first side display unit, wherein the first side display unit extends substantially vertically away from a floor, and a second side display unit extending substantially vertically away from the floor to a top surface of the second side display unit, the second side display unit being laterally spaced from the first side display unit, and a transom display unit selectively coupled with each of the first side display unit and the second side display unit to form a walkable pathway under the transom display unit between the first side display unit and the second side display unit, the transom display unit including a bottom segment having a first pair of coupling apertures near a first end of the bottom segment;

wherein the display fixture is adjustable between a first configuration and a second configuration, in the first configuration, the first side display unit extends substantially in line with the transom display unit and is coupled to the transom display unit via two fasteners each extending through a different one of the first pair of coupling apertures and a different one of the two threaded cavities, and in the second configuration, the first side display unit is rotated out of line with the transom display unit and is coupled to the transom display unit via a single fastener extending through only one of the first pair of coupling apertures and only one of the two threaded cavities;

auxiliary display components coupled to the first side display unit; and merchandise supported by the auxiliary display components.

18. The retail display of claim 17, wherein:

the bottom segment of the transom display unit includes a second pair of coupling apertures near a second end of the bottom segment opposite the first end of the bottom segment, the second side display unit includes a second two threaded cavities along a top surface of the second side display unit, and at least one second fastener is secured to at least one of the second two threaded cavities through at least one of the second pair of coupling apertures to selectively secure the second side display unit to the transom display unit.

19. The retail display of claim 17, wherein:

the first side display unit of the display fixture includes a principle frame portion and an auxiliary frame portion, the principle frame portion includes two upright members, a top cross bar, and a bottom cross bar collectively defining an opening therebetween, and a panel maintained within and substantially covering the opening, the auxiliary frame portion extends from one of the two upright members in a direction opposite the other one of the two upright members and has a height substantially equal to a height of the principle frame portion, the auxiliary frame portion includes a vertical member spaced from the one of the two upright members and a second top cross bar extending from the one of the two upright members to the vertical member, and the two threaded cavities are each formed in a top surface of the auxiliary frame portion.

20. The retail display of claim 19, wherein the transom display unit is only coupled with the first display unit via the auxiliary frame portion of the first side display unit.

* * * * *